US008262079B2

(12) United States Patent
Uchino

(10) Patent No.: US 8,262,079 B2
(45) Date of Patent: Sep. 11, 2012

(54) IMAGE RECORDING APPARATUS WITH SHEET CONVEYANCE PATH

(75) Inventor: Yuta Uchino, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/075,924

(22) Filed: Mar. 30, 2011

(65) Prior Publication Data

US 2012/0074637 A1 Mar. 29, 2012

(30) Foreign Application Priority Data

Sep. 27, 2010 (JP) ..... 2010-216007
Sep. 27, 2010 (JP) ..... 2010-216010

(51) Int. Cl.
*B65H 5/00* (2006.01)

(52) U.S. Cl. ..... 271/10.03; 271/10.11; 271/265.01

(58) Field of Classification Search ..... 271/225, 271/272–274, 10.03, 10.11, 265.01, 264, 271/5, 4.03, 4.1; 347/104
See application file for complete search history.

(56) References Cited

U.S. PATENT DOCUMENTS

| | | | | |
|---|---|---|---|---|
| 6,149,045 | A * | 11/2000 | Kadono | 226/196.1 |
| 6,681,096 | B2 * | 1/2004 | Seto et al. | 399/388 |
| 7,415,239 | B2 * | 8/2008 | Saito et al. | 399/388 |
| 7,533,878 | B2 * | 5/2009 | Cook et al. | 271/114 |
| 2009/0295067 | A1 * | 12/2009 | Yanagishita | 271/10.12 |
| 2010/0001461 | A1 * | 1/2010 | Takeshita | 271/274 |

FOREIGN PATENT DOCUMENTS

| | | | |
|---|---|---|---|
| JP | H09-034202 | A | 2/1997 |
| JP | 2010-083601 | A | 4/2010 |

* cited by examiner

*Primary Examiner* — Jeremy R Severson
(74) *Attorney, Agent, or Firm* — Scully, Scott, Murphy & Presser, PC

(57) ABSTRACT

An image recording apparatus including a recording portion for recording image on a top face of a sheet; a supplying roller which is to be in contact with a bottom face of the sheet held in a tray so as to supply the sheet toward a curved conveyance path, a drive roller which is to be in contact with the top face of the sheet so as to convey the sheet supplied from the supplying roller, and a controlling portion which is configured, upon receipt of a command requesting start of conveyance of the sheet, to cause the supplying roller to be rotated without causing the drive roller to be rotated, and is configured, upon judgment that a leading end portion of the sheet has reached a flat surface extending away from the drive roller toward the recording portion, to cause the drive roller to be rotated.

16 Claims, 17 Drawing Sheets

IMAGE RECORDING APPARATUS WITH SHEET CONVEYANCE PATH

CROSS REFERENCE TO RELATED APPLICATION

This application claims priority from Japanese Patent Applications No. 2010-216007 and No. 2010-216010 filed on Sep. 27, 2010, the disclosures of which are herein incorporated by reference in their entirety.

BACKGROUND OF THE INVENTION

Field of the Invention

The present invention relates to an image recording apparatus provided with a curve-shaped conveyance path along which a sheet is to be conveyed by a pair of rollers disposed in the curve-shaped conveyance path.

In an image recording apparatus that is capable of recording image on a sheet, commonly, a sheet conveyance path is provided with at least one pair of rollers that are disposed in the sheet conveyance path. In such an image recording apparatus, the sheet is conveyed along the sheet conveyance path by the pair of rollers which cooperate to nip the sheet therebetween. In most cases, the pair of rollers consist of a drive roller and a driven roller.

Further, in most cases, the sheet conveyance path of the image recording apparatus includes a curved path section in the interest of reducing an overall size of the apparatus. Where the sheet conveyance path includes a curved path section, the sheet conveyance path has a generally U shape as a whole so that the sheet conveyed along the sheet conveyance path is caused to make a U turn. In this case, at least one pair of the above-described at least one pair of rollers are disposed in the curved path section of the sheet conveyance path.

Further, in some cases, the image recording apparatus has a pivotable arm and a supplying roller. The pivotable arm is disposed above a tray that is configured to hold a sheet, and is pivotable about its fulcrum whereby a distal end portion of the arm is vertically displaceable. The supplying roller is provided in the distal end portion of the arm, and is to rotated for supplying the sheet from the tray to the sheet conveyance path.

SUMMARY OF THE INVENTION

In an image recording apparatus having a supplying roller and a pair of rollers that are disposed in a curve-shaped conveyance path, normally, a sheet is supplied by the supplying roller from a tray to the pair of rollers, and then, when the sheet has reached the pair of rollers, the pair of rollers are rotated (more precisely, a drive roller as one of the rollers is driven) while rotation of the supplying roller is stopped, whereby the sheet is conveyed, along the curve-shaped conveyance path, by rotation of the pair of rollers.

The sheet conveyed by the pair of rollers is caused to collide at its leading end portion with a guide surface defined by a section of the curve-shaped conveyance path which is located on a downstream side, as viewed in the sheet conveyance direction, of the pair of rollers. Since the guide surface is curved, the sheet having been caused to collide at its leading end portion with the guide surface becomes bent along the curved guide surface, as the sheet is further conveyed along the curve-shaped conveyance path, so that the sheet is brought into contact at one of its opposite faces with the guide surface. As a result of the contact of the sheet with the guide surface, the sheet receives an opposite force acting in a direction opposite to a sheet conveyance direction in which the sheet is conveyed. This opposite force is increased with increase of an area of a contact portion of the surface of the sheet which is in contact with the guide surface. When the opposite force is larger than a conveying force that forces the sheet to be conveyed along the conveyance path, the sheet is not conveyed in spite of rotation of the drive roller. In this instance, a rolling surface of the drive roller is caused to slip on the surface of the sheet, and the rolling surface of the drive roller is deteriorated by the slipping with the surface of the sheet. There is a possibility that the surface of the sheet could be affected by the thus deteriorated rolling surface of the drive roller as a result of the contact of the surface of the sheet with the deteriorated rolling surface. There is a risk that it would be impossible to satisfactorily record image on such a negatively influenced surface of the sheet, namely, it would be impossible to obtain satisfactory quality of the image record image on such a negatively influenced surface of the sheet.

Further, in the image recording apparatus, where the apparatus is provided with a plurality of pairs of rollers which are arranged at a given pitch in a direction of width of the sheet (that is to be conveyed along the sheet conveyance path), the sheet is to be nipped by the plurality of pairs of rollers, namely, nipped between the drive rollers and the driven rollers. The pairs of rollers are likely to be different from each other with respect to a nipping force, i.e., a force by which the sheet is to be nipped between the drive and driven rollers of each pair of rollers. This means that there is a risk that the sheet would be nipped by the force that is not constant over the entire width of the sheet. Particularly, where there is a difference between the pairs of rollers that nip widthwise opposite end portions of the sheet, with respect to the nipping force, the sheet could be move or conveyed in a direction inclined with respect to the sheet conveyance path.

It might be possible to prevent the sheet from being conveyed in the inclined direction, by employing an arrangement in which the pairs of rollers are disposed only in central or intermediate positions corresponding to a central or intermediate portion of the sheet in the sheet width direction, without the pairs of rollers being disposed in opposite end positions corresponding to opposite end portions of the sheet in the sheet width direction.

However, in this arrangement in which the drive and drive rollers are disposed only in the central or intermediate positions, the drive rollers are not mounted on longitudinally opposite end portions of the shaft, so that the opposite end portions of the sheet are not nipped by the pairs of rollers, namely, so that movements of the opposite end portions of the sheet are not limited by any means.

Further, where the pairs of rollers are disposed in a curved path section of the sheet conveyance path, the widthwise opposite end portions of the sheet, which are not nipped by the pairs of rollers, are bent outwardly by a certain degree of angle with respect to the sheet conveyance direction. Therefore, where the drive rollers are disposed on a side of the outside guide surface, the widthwise opposite end portions of the sheet are brought into contact with the longitudinally opposite end portions of the shaft, so that there is a risk that the sheet could be folded or broken.

The present invention was made in view of the above-described background factors. It is therefore a first object of the invention to provide an image recording apparatus capable of satisfactorily maintaining quality of image recorded on a sheet, by preventing deterioration of a conveying roller provided for conveying the sheet. A second object of the invention is to provide a structure capable of preventing a sheet from being conveyed in a direction inclined with respect to a sheet conveyance direction, without causing a risk of folding or breakage of the sheet.

The first object of the invention may be achieved according to a first aspect of the invention, which provides an image recording apparatus including: (a) a conveyance path definer including outside and inside guide surfaces which are opposed to each other and which cooperate with each other to define therebetween a conveyance path, along which a sheet is to be conveyed in a sheet conveyance direction while one and the other of opposite side faces of the sheet face the outside and inside guide surfaces, respectively, the conveyance path having a curved path section and a straight path section that is located on a downstream side of the curved path section; (b) a tray configured to hold a sheet; (c) a supplying roller which is to be in contact with the other of the opposite side faces of the sheet held by the tray, and which is configured to supply the sheet from the tray toward the curved path section of the conveyance path; (d) a pair of conveying rollers which are located in the curved path section of the conveyance path, and which are configured to convey the sheet supplied from the supplying roller, toward the straight path section of the conveyance path, the pair of conveying rollers including a drive roller and a driven roller, the drive roller being rotatable by a drive force transmitted thereto and disposed on a side of the outside guide surface so as to be brought into contact with the one of the opposite side faces of the sheet, the driven roller being opposed to the drive roller and disposed on a side of the inside guide surface so as to be brought into contact with the other of the opposite side faces of the sheet; (e) a recording portion which is located in the straight path section of the conveyance path, and which is disposed on a side of the outside guide surface so as to record image on the one of the opposite side faces of the sheet; and (f) a controlling portion which is configured to control the supplying roller and the drive roller, (g) wherein the outside guide surface includes a sheet supporting portion constituted by a flat surface which faces the curved section and which extends away from the drive roller toward the straight path section, the image recording apparatus further including: (h) a judging portion configured to make judgment relating to a position of a leading end portion of the sheet, (i) wherein the controlling portion is configured, upon receipt of a command requesting start of conveyance of the sheet, to cause the supplying roller to be rotated without causing the drive roller to be rotated, and is configured, upon judgment that the leading end portion of the sheet has reached the sheet supporting portion, to cause the drive roller to be rotated.

The second object of the invention may be achieved according to a second aspect of the invention, which provides a conveying device including: (a) a conveyance path definer including outside and inside guide surfaces which are opposed to each other and which cooperate with each other to define therebetween a curved conveyance path along which a sheet is to be conveyed in a sheet conveyance direction; (b) a pair of support members disposed outside respective opposite ends of the curved conveyance path in a first direction which is perpendicular to the sheet conveyance direction and which is parallel to a direction of width of the curved conveyance path; (c) a shaft disposed on a side of the outside guide surface, and located in a position which is more distant from the inside guide surface than from the outside guide surface in a second direction that is perpendicular to the first direction and the sheet conveyance direction, the shaft being rotatably supported at opposite end portions thereof by the support members; (d) a first roller disposed on a non-end portion of the shaft in the first direction, and rotatable together with the shaft; (e) a second roller disposed on a side of the inside guide surface, and opposed to the first roller such that the first roller and the second roller cooperate to convey the sheet by nipping the sheet therebetween; (f) a pair of guide-surface members disposed on respective non-central portions of the shaft in the first direction, each of the guide-surface members having a sheet guide surface, (g) wherein the non-central portions of the shaft are located on respective opposite sides of the non-end portion of the shaft in the first direction, and (h) wherein a distance between the inside guide surface and the sheet guide surface is smaller than a distance between the inside guide surface and the shaft. It is noted that this second aspect of the invention may be carried out with combination of the above-described first aspect of the invention.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
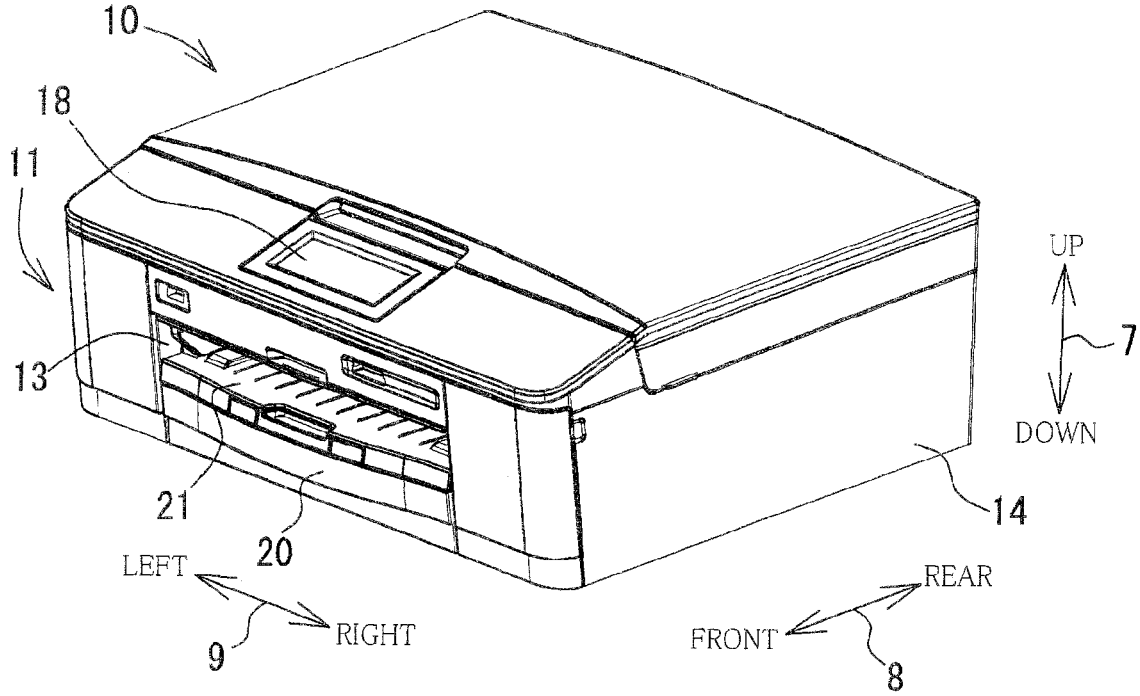
FIG. 1 is a perspective view of a compound machine 10 that is constructed according a first embodiment of the invention.

There will be described embodiments of the present invention, by reference to the accompanying drawings. It is noted that the embodiments will be described for illustrative purpose only and that the invention may be embodied with various changes, modifications and improvements, which may occur to those skilled in the art, without departing from the spirit of the invention. It is further noted that, in the following description, there will be used terms "upper", "lower", "right", "left", "front" and "rear" directions of a compound machine 10 which are directions as seen in FIG. 1, and which are indicated by respective arrows "UP", "DOWN", "RIGHT", "LEFT", "FRONT" and "REAR" in the drawings.

[Compound Machine 10]

As shown in FIG. 1, the compound machine 10, which is an example of an image recording apparatus according to the invention, has a generally rectangular parallelepiped body with a low profile. An opening 13 is provided in a front portion of the machine 10, and a inkjet-type printer unit 11 is provided in a lower portion of the machine 10. The compound machine 10 has various functions such as facsimile and printer functions. In the present first embodiment, although the printer unit 11 is capable of performing an one-side recording operation, the printer unit 11 may be modified to have a function of performing a both-side recording operation. The printer unit 11 has a housing body 14 in which the opening 13 opens in its front face, so that a sheet supply tray 20 (as an example of a tray) and a sheet exit tray 21 can be introduced into and removed from an inner space of the machine 10 via the opening 13, by moving the trays 20, 21 in a front-rear direction indicated by arrows 8. In the sheet supply tray 20, recording sheets (as examples of sheets) of desired sizes can be stacked or held. It is noted that arrows 7 indicate an up-down direction and that arrows 9 indicate a right-left direction.

Figure 2:
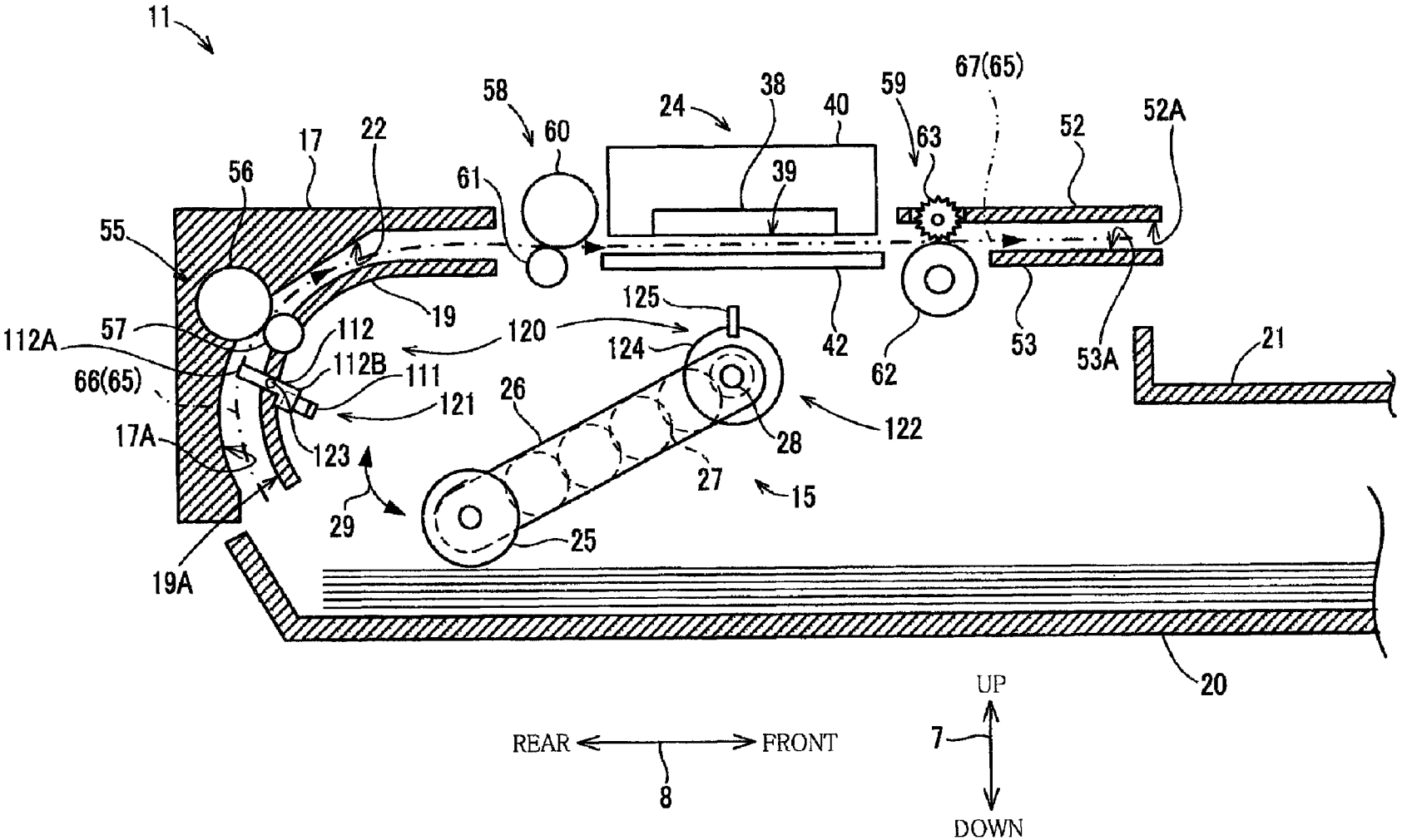
FIG. 2 is a cross sectional view schematically showing an internal construction of a printer unit 11 that is included in the compound machine 10.

As shown in FIG. 2, the printer unit 11 includes a sheet supplying portion 15 configured to supply the recording sheets, and a recording portion 24 (as an example of a recording portion) configured to record image on each of the recording sheets by ejecting ink onto each recording sheet. Thus, the printer unit 11 is configured to record, on the recording sheet, image based on a print data transmitted from an external device.

[Sheet Supplying Portion 15]

As shown in FIG. 2, the sheet supplying portion 15 is located on an upper side of the sheet supply tray 20. The sheet supplying portion 15 includes a sheet supplying roller 25 (as an example of a supplying roller), a pivotable arm 26 and a first drive-force transmitting mechanism 27 (as an example of a first transmission mechanism) that is constituted principally by a plurality of gears meshing with each other. The sheet supplying roller 25 is held at its shaft by a distal end portion of the pivotable arm 26. The pivotable arm 26 is pivotable about a shaft 28 (that is provided in a proximal end portion of the arm 26) in directions indicated by arrows 29. With pivot motion of the arm 26, the sheet supplying roller 25 can be brought into contact with the sheet supply tray 20 and can be separated from the sheet supply tray 20, namely, the sheet supplying roller 25 can be displaced toward and away from the sheet supply tray 20. Thus, the sheet supplying roller 25 can be brought into contact with the recording sheet held in the sheet supply tray 20. The sheet supplying roller 25 is rotatable by a drive force that is transmitted from a second drive motor 102 (as an example of a drive source) (see FIG. 3) via the first drive-force transmitting mechanism 27. The sheet supplying roller 25 is to be held in contact with an uppermost one of the recording sheets stacked in the sheet supply tray 20, and is configured to separate the uppermost sheet from the other sheets so as to supply the sheet to a curved path section (U-turn section) 66 of a sheet conveyance path 65.

In an arrangement where the recording sheet is to be supplied to the curved path section 66 of the sheet conveyance path 65 by the sheet supplying roller 25, as shown in FIG. 2, one of opposite side surfaces of the recording sheet is caused to be face an outside guide surface 17A, while the other of the opposite side surfaces of the recording sheet (with which the sheet supplying roller 25 has been in contact) is caused to face an inside guide surface 19A.

[Sheet Conveyance Path 65]

As shown in FIG. 2, the printer unit 11 defines therein the sheet conveyance path 65 (as an example of a conveyance path) which is configured to guide the recording sheet to be conveyed from an end (i.e., rear end portion) of the sheet supply tray 20 to the sheet exit tray 21 via the recording portion 24.

The sheet conveyance path 65 is sectioned into the above-described curved path section 66 (as an example of a curved path section) extending from the end of the sheet supply tray 20 to first pairs of rollers 58, and a straight path section 67 (as an example of a straight path section) extending from the first pairs of rollers 58 to the sheet exit tray 21 via a region right below the recording portion 24. That is, in the sheet conveyance path 65, the curved path section 66 and the straight path section 67 are disposed.

The curved path section 66 is a curved path extending from a vicinity of the end of the sheet supply tray 20 to the first pairs of rollers 58. While being in the curved path section 66, the recording sheet is caused to be bent and guided so as to be conveyed curvedly along a sheet conveyance path (indicated by one-dot chain line in FIG. 2) in a sheet conveyance direction (indicated by arrows disposed on the one-dot chain line in FIG. 2). The curved path section 66 and the straight path section 67 are connected to each other, with the first pairs of rollers 58 being disposed at the connection between the curved path section 66 and the straight path section 67. Thus, the recording sheet is guided by the curved path section 66 to the straight path section 67 which is located on a downstream side, as viewed in the sheet conveyance direction, of the curved path section 66. The curved path section 66 is defined between an inside guide member 19 and an outside guide member 17 which are opposed to each other and are spaced apart from each other by a predetermined distance. In other words, the curved path section 66 is defined between the inside guide surface 19A (as an example of an inside guide surface) and the outside guide surface 17A (as an example of an outside guide surface) which are constituted by a rear surface of the inside guide member 19 and a front surface of the outside guide member 17, respectively. The curved path section 66 is curved to be convex in a direction toward the a side of the outside guide surface 17A away from the side of the inside guide surface 19A.

It is noted that the outside guide surface 17A is a generally curved surface except its portion that is constituted by a flat surface 22, which is described below.

Each of the inside guide surface 19A and the outside guide surface 17A may be constituted by either a single surface or a plurality of surfaces. In an arrangement where each of the guide surfaces 19A, 17A is constituted by a plurality of surfaces, for example, a plurality of ribs may be provided to extend along the sheet conveyance path 65 and protrude from the inside guide surface 19A and/or the outside guide surface 17A toward the sheet conveyance path 65. In this arrangement, distal end faces of the respective ribs constitute respective surfaces, so that the inside guide surface 19A and/or the outside guide surface 17A are constituted by the plurality of surfaces.

The straight path section 67 is a straight path extending in the front-rear direction 8 from the first pairs of rollers 58, i.e., a downstream end, as viewed in the sheet conveyance direction, of the curved path section 66, to the sheet exit tray 21. While being in the straight path section 67, the recording sheet is caused to be guided so as to be conveyed straightly along the sheet conveyance path (indicated by two-dot chain line in FIG. 2) in the sheet conveyance direction (indicated by arrows disposed on the two-dot chain line in FIG. 2). After being subjected to a recording operation carried out by the recording portion 24, the sheet is discharged to the sheet exit tray 21. The recording portion 24 faces a region of the straight path section 67 which is defined between the recording portion 24 and a platen 42 that are opposed to each other and spaced apart from each other by a predetermined distance. Another region of the straight path section 67, which the recording portion 24 does not face, is defined between an upper-side guide member 52 and a lower-side guide member 53 that are opposed to each other and spaced apart from each other by a predetermined distance. In other words, like the curved path section 66, the straight path section 67 is defined between an upper-side guide surface 52A (as an example of the outside guide surface) and a lower-side guide surface 53A (as an example of the inside guide surface) which are constituted by a lower surface of the upper-side guide member 52 and an upper surface of the lower-side guide member 53, respectively.

[Recording Portion 24]

As shown in FIG. 2, the recording portion 24 is disposed on an upper side of the straight path section 67 of the sheet conveyance path 65, i.e., on a side of the upper-side guide surface 52A of the straight path section 67. The recording portion 24 includes a recording head 38 and a carriage 40 which carries the recording head 38 and which is to be reciprocated in a main scanning direction (i.e., direction perpendicular to drawing sheet of FIG. 2). The recording head 38 is configured to receive inks that are to be supplied from ink cartridges (not shown), and to eject the inks in the form of small ink droplets through nozzles 39. With the carriage 40 being reciprocated in the main scanning direction, the recording head 38 is caused to scan the recording sheet, whereby image is recorded onto the recording sheet which is supported on the platen 42 while being conveyed along the sheet conveyance path. It is noted that the platen 42 is disposed on a lower side of the straight path section 67 and is opposed to the recording portion 24.

[First Pairs of Rollers 58 & Second Pairs of Rollers 59]

As shown in FIG. 2, the first pairs of rollers 58 are disposed on an upstream side, as viewed in the sheet conveyance direction, of the recording portion 24. Each pair of the first pairs of rollers 58 consist of a first conveying roller 60 which is disposed on an upper side of the sheet conveyance path 65 (i.e., upper side of the curved path section 66 and straight path section 67) and a pinch roller 61 which is disposed on a lower side of the sheet conveyance path 65 (i.e., lower side of the curved path section 66 and straight path section 67). The pinch roller 61 is biased by a biasing member (not shown) such as a spring, and is held in pressing contact with a rolling surface of the first conveying roller 60. The first pairs of rollers 58 are configured to nip the recording sheet, and to feed the recording sheet onto the platen 42.

Further, as shown in FIG. 2, second pairs of rollers 59 are disposed on a downstream side, as viewed in the sheet conveyance direction, of the recording portion 24. Each pair of the second pairs of rollers 59 consist of a second conveying roller 62 which is disposed on a lower side of the sheet conveyance path 65 (i.e., lower side of the straight path section 67) and a spur roller (rowel) 63 which is disposed on an upper side of the sheet conveyance path 65 (i.e., upper side of the straight path section 67). The spur roller 63 is biased by a biasing member (not shown) such as a spring, and is held in pressing contact with a rolling surface of the second conveying roller 62. The second pairs of rollers 59 are configured to nip the recording sheet having passed the recording portion 24, and to convey the recording sheet to the sheet exit tray 21.

Figure 5:
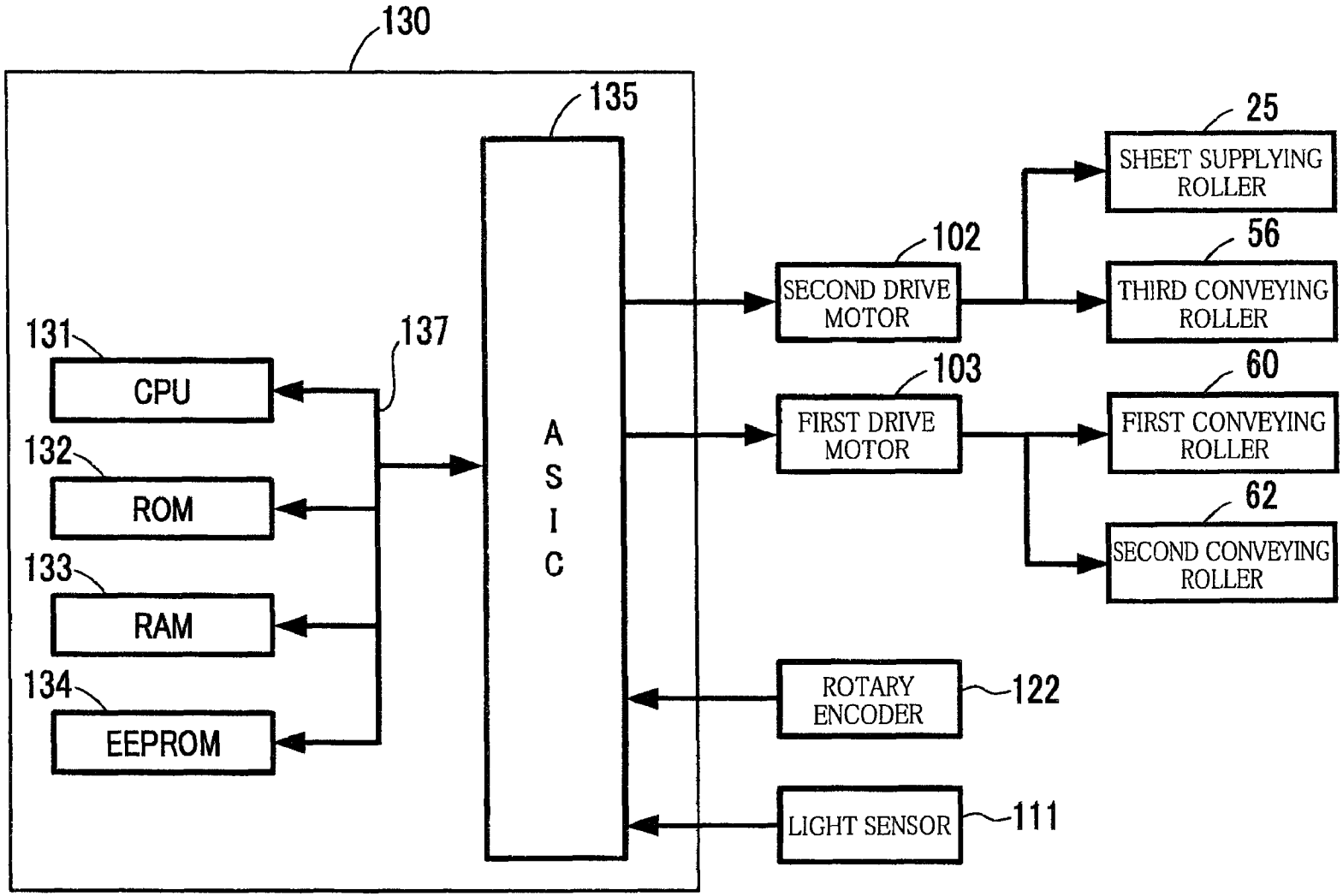
FIG. 5 is a block diagram showing a construction of a controlling portion 130 included in the compound machine 10.

Each of the first and second conveying rollers 60, 62 can be rotated by a rotary drive force that is to be transmitted thereto from a first drive motor 103 (see FIG. 5). When the first drive motor 103 is rotated in one of forward and reverse directions, the recording sheet is conveyed in the sheet conveyance direction.

[Third Pairs of Rollers 55]

As shown in FIG. 2, third pairs of rollers 55 (each pair of which is as an example of a pair of conveying rollers) are disposed on an upstream side, as viewed in the sheet conveyance direction, of the first pairs of rollers 58. Each pair of the third pairs of rollers 55 consist of a third conveying roller 56 (as an example of a drive roller) which is disposed on a side of the outside guide surface 17A and a pinch roller 57 (as an example of a driven roller) which is disposed on a side of the inside guide surface 19A. Each pinch roller 57 is opposed to the corresponding third conveying roller 56, and is biased by a biasing member (not shown) such as a spring so as to be held in pressing contact with a rolling surface of the corresponding third conveying roller 56. The third pairs of rollers 55 are configured to nip the recording sheet and to convey the recording sheet toward the first pairs of rollers 58.

[Transmission Selector 110]

Figure 3:
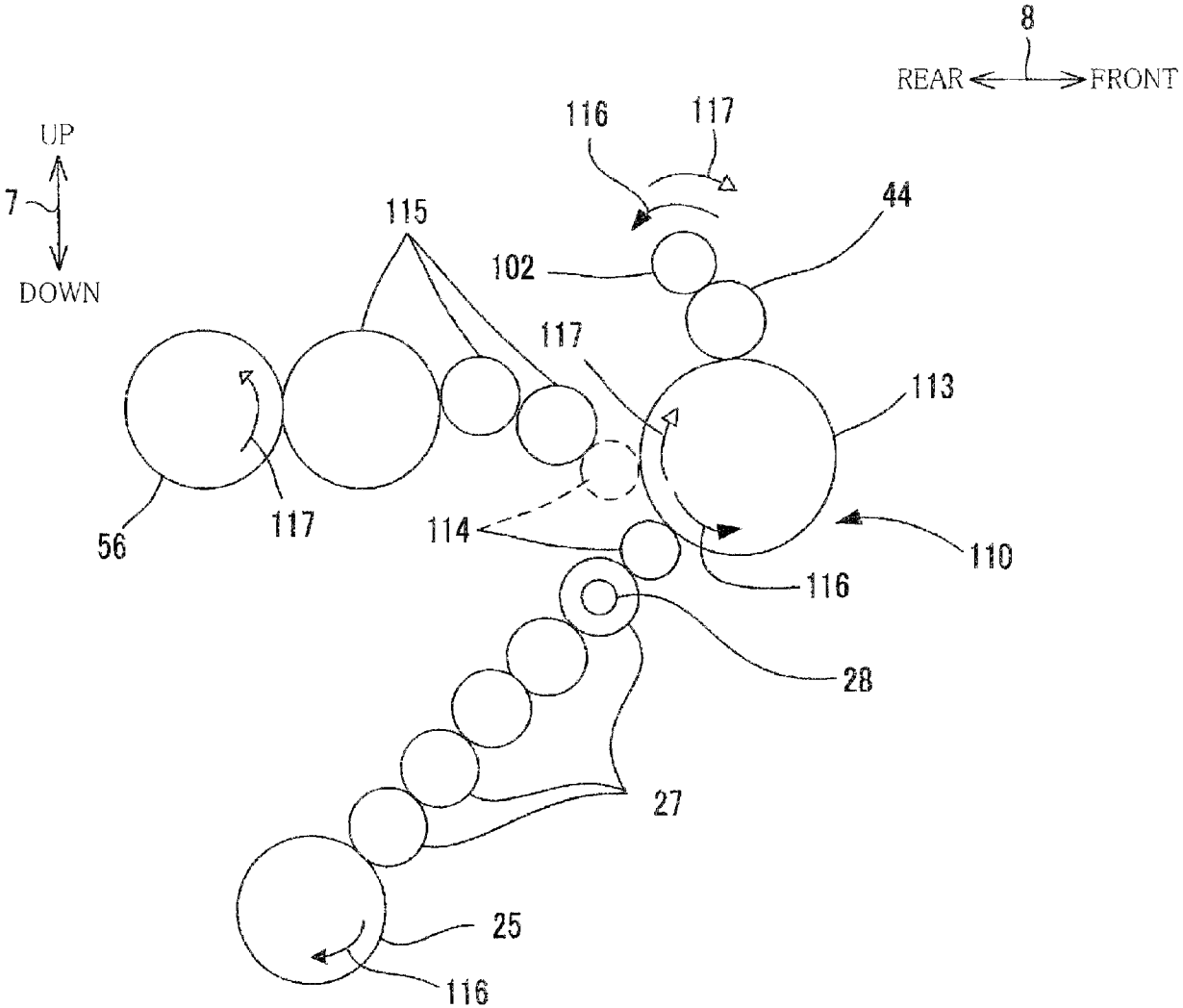
FIG. 3 is a view schematically showing a transmission selector 110 and first and second drive-force transmission mechanisms 27, 115 that are included in the compound machine 10.

As shown in FIG. 3, the sheet supplying roller 25 is rotated when a rotary drive force is transmitted thereto from the second drive motor 102 via a transmission selector 110 (as an example of a transmission selector) and the first drive-force transmitting mechanism 27, namely, when the transmission selector 110 selects the first drive-force transmitting mechanism 27 for thereby causing the rotary drive force to be transmitted via the selected first drive-force transmitting mechanism 27 to the sheet supplying roller 25. On the other hand, the third conveying roller 56 is rotated when the rotary drive force is transmitted thereto from the second drive motor 102 via the transmission selector 110 and a second drive-force transmitting mechanism 115 (as an example of a second transmission mechanism), namely, when the transmission selector 110 selects the second drive-force transmitting mechanism 115 for thereby causing the rotary drive force to be transmitted via the selected second drive-force transmitting mechanism 115 to the third conveying roller 56. It is noted that the second drive-force transmitting mechanism 115 is constituted by a plurality of gears meshing with each other.

The transmission selector 110 includes a sun gear 113 and a planet gear 114. The sun gear 113 meshes with an intermediate gear 44 that is configured to transmit the rotary drive force from the second drive motor 102. The planet gear 114 is to be rotated while being revolved around the sun gear 113. When the second drive motor 102 is rotated in a reverse direction (indicated by arrow 117 in FIG. 3), the planet gear 114 is revolved around the sun gear 113 so as to be positioned in a position (indicated by broken line 114 in FIG. 3) in which the planet gear 114 is caused to mesh with one of the gears constituting the second drive-force transmitting mechanism 115. On the other hand, when the second drive motor 102 is rotated in a forward direction (indicated by arrow 116 in FIG. 3), the planet gear 114 is revolved around the sun gear 113 so as to be positioned in a position (indicated by solid line 114 in FIG. 3) in which the planet gear 114 is caused to mesh with one of the gears constituting the first drive-force transmitting mechanism 27. Owing to this construction, the transmission selector 110 is configured, when the second drive motor 102 is rotated in the forward direction, to transmit the rotary drive force from the second drive motor 102 to the sheet supplying roller 25, and is configured, when the second drive motor 102 is rotated in the reverse direction, to transmit the rotary drive force from the second drive motor 102 to the third conveying roller 56. In other words, the transmission selector 110 is configured to select, based on the direction of rotation of the second drive motor 102, one of the first and second drive-force transmitting mechanisms 27, 115, for thereby causing the rotary drive force to be transmitted, via the selected one of the first and second drive-force transmitting mechanisms 27, 115, to a corresponding one of the sheet supplying roller 25 and the third conveying roller 56.

The third conveying roller 56 is arranged to be freely rotatable in a state in which the rotary drive force is not transmitted thereto from the second drive motor 102, i.e., in a state in which the planet gear 114 does not mesh with the gear of the second drive-force transmitting mechanism 115. Owing to this arrangement, the third conveying roller 56 can be rotated together with conveyance of the recording sheet, when the recording sheet is further conveyed by the sheet supplying roller 25 after having been brought into contact with the third conveying roller 56.

[Flat Surface 22]

Figure 4:
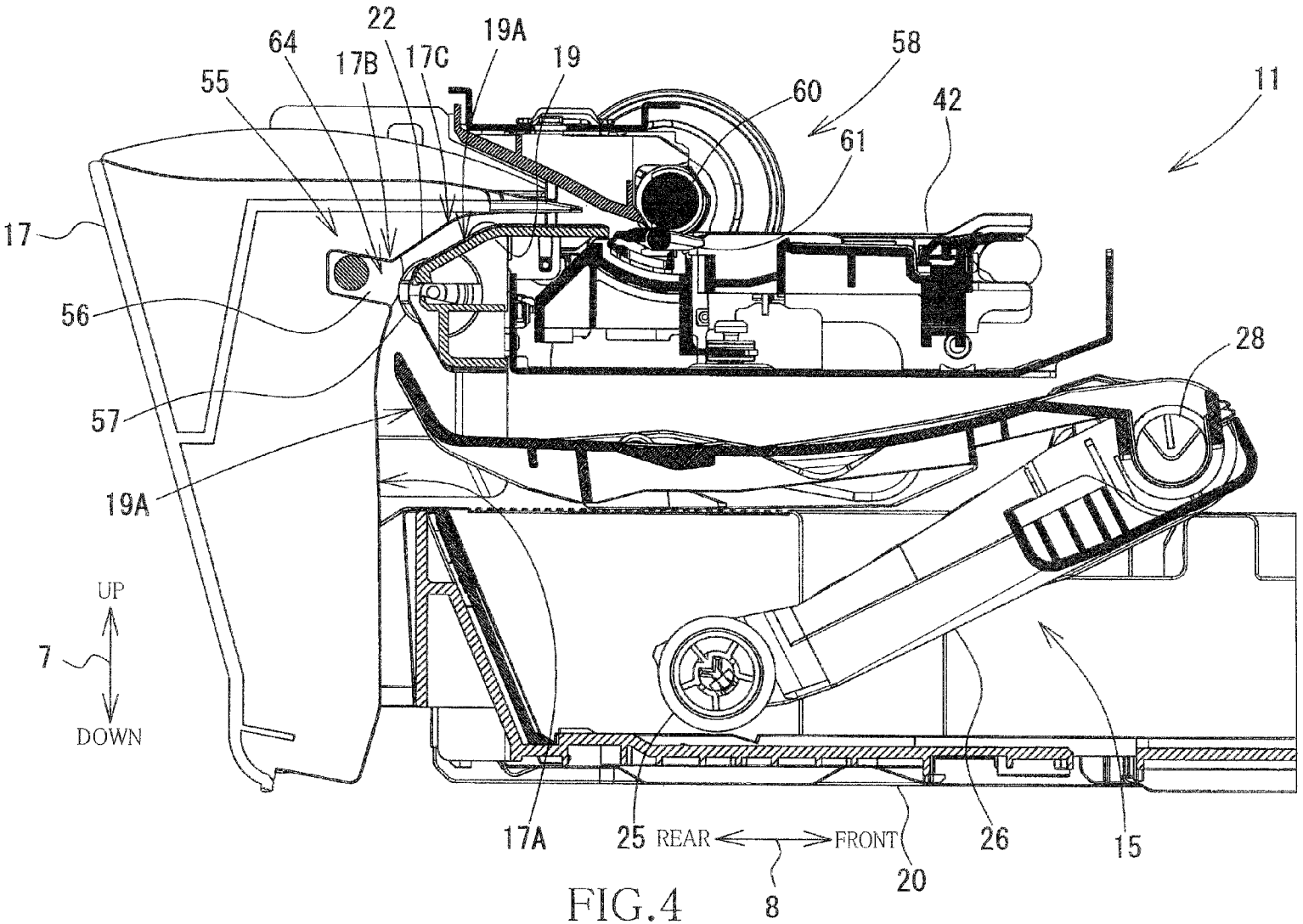
FIG. 4 is a cross sectional view showing the internal construction of the printer unit 11.

As shown in FIGS. 2 and 4, a major part of the outside guide surface 17A of the outside guide member 17 is curved to define the curved path section 66. However, the flat surface 22 (as an example of a sheet supporting portion constituted by a flat surface) is provided on an immediately downstream side, as viewed in the sheet conveyance direction, of a position 17B in which the third conveying roller 56 is disposed. The position 17B corresponds to a downstream end, as viewed in the sheet conveyance direction, of a recessed portion 64. The recessed portion 64 is provided for receiving therein a shaft of the third conveying roller 56.

The flat surface 22 may extend from the position 17B either to a downstream end, as viewed in the sheet conveyance direction, of the curved path section 66, or to a midway position located on an upstream side, as viewed in the sheet conveyance direction, of the downstream end of the curved path section 66. In the present first embodiment, the flat surface 22 is constituted by a portion of the outside guide surface 17A, which extends from the position 17B to a position 17C that is substantially the center between the third pairs of rollers 55 and the first pairs of rollers 58. Meanwhile, the outside guide surface 17A includes a curved portion that is located on a downstream side, as viewed in the sheet conveyance direction, of the position 17C.

The flat surface 22 extends from the position 17B in a forward and upward direction. Described specifically, a front end portion (i.e., a downstream end portion) of the flat surface 22 is located on an upper side of a rear end portion (i.e., an upstream end portion) of the flat surface 22. In other words, a height position of the flat surface 22 is increased as the flat surface 22 extends forwardly. The outside guide surface 17A includes, in addition to the sheet supporting portion in the form of the flat surface 22, an upstream-side non-flat portion and an downstream-side non-flat portion which are located on upstream and downstream sides of the flat surface 22, wherein a direction of a tangent line tangent to the outside guide surface 17A is changed at a boundary between the flat surface 22 and the downstream-side non-flat portion by a degree smaller than a degree by which the direction of the tangent line is changed at a boundary between the flat surface 22 and the upstream-side non-flat portion.

As described above, the outside guide surface 17A may be constituted by a plurality of surfaces. Therefore, the flat surface 22, which constitutes a portion of the outside guide surface 17A, may be consisted by a plurality of surfaces. For example, a plurality of ribs may be provided to extend along the sheet conveyance path 65 and protrude from the flat surface 22 toward the sheet conveyance path 65. In this arrangement, distal end faces of the respective ribs constitute respective surfaces, so that the flat surface 22 is constituted by the plurality of surfaces.

Figure 7A:
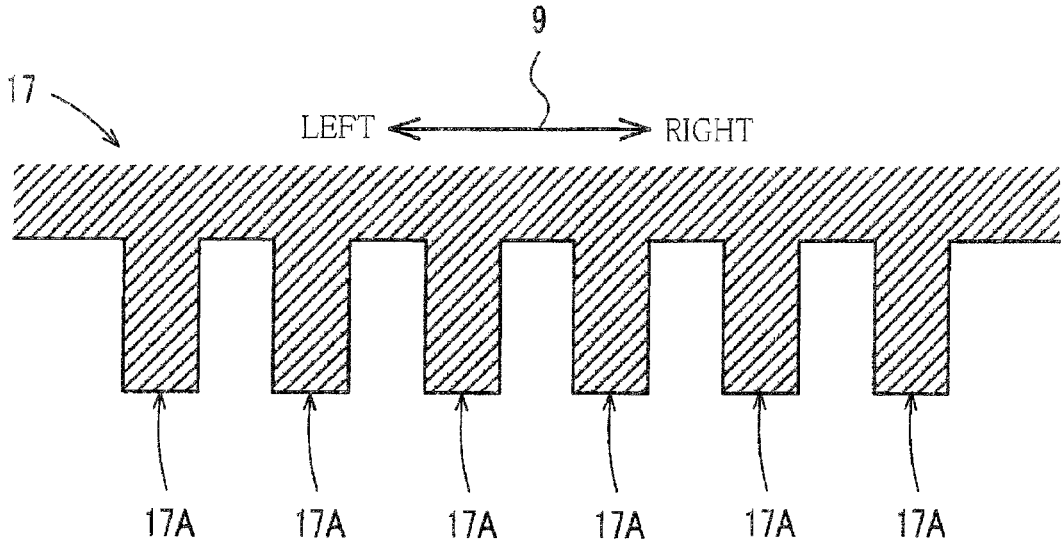
FIG. 7A is a cross sectional view showing a part of an outside guide member 17 where a plurality of rectangular-shaped ribs are provided on an outside guide surface 17A.
Figure 7B:
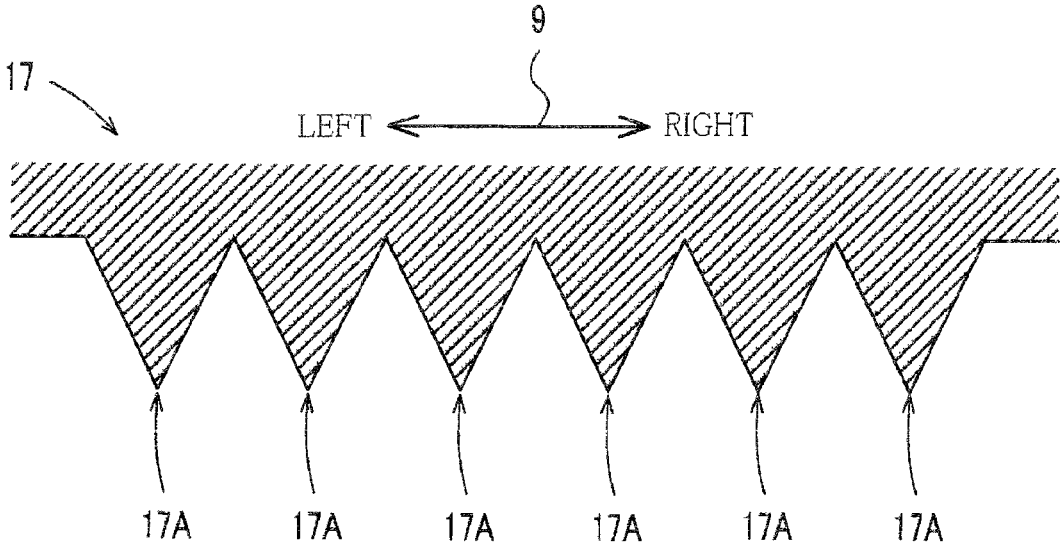
FIG. 7B is a cross sectional view showing a part of an outside guide member 17 where a plurality of triangular-shaped ribs are provided on an outside guide surface 17A.

In the present first embodiment, each of the ribs has a rectangular shape in its cross section as shown in FIG. 7A. However, the cross sectional shape of each of the ribs does not have to be rectangular but may be triangular as shown in FIG. 7B. In this case of FIG. 7B, each rib has a sharp-pointed distal end portion. That is, the distal end face of each rib has a generally linear shape or an elongated shape.

[Judging Portion 120]

As shown in FIG. 2, the printer unit 11 has a judging portion 120 (as an example of a judging portion) including a detector 121 (as an example of a leading-end-portion detector) and a rotary encoder 122 (as an example of a rotation-amount detector). The detector 121 is configured to detect a leading end portion of the sheet which has been supplied from the sheet supply tray 20 and which is being conveyed along the curved path section 66. The rotary encoder 122 is configured to detect an amount of rotation of the sheet supplying roller 25. It is noted that the judging portion 120 is not represented in FIG. 4.

The detector 121 is disposed on an upstream side, as viewed in the sheet conveyance direction, of the third pairs of rollers 55 in the curved path section 66. The detector 121 is constituted by, for example, a rotatable body 112 and a light sensor 111 such as a photo interrupter having a light emitting element (e.g., light emitting diode) and a light receiving element (e.g., photo transistor) that is configured to receive the light emitted from the light emitting element. The rotatable body 112 has detecting elements 112A, 112B, and is rotatable about a support shaft 123. The detecting element 112A protrudes toward the curved path section 66 away from the support shaft 123. In a state in which an external force is not being applied to the rotatable body 112, the detecting element 112B is introduced into a light path that extends from the light emitting element to the light receiving element, so as to interrupt a light passing along the light path. When the rotatable body 112 is forced by the distal end portion of the recording sheet, the rotatable body 112 is rotated whereby the detecting element 112B is displaced away from the light path so that the light is allowed to pass along the light path.

The rotary encoder 122 is constituted principally by an optical sensor 125 and an encoder disk 124 which is attached to the shaft 28 so as to be rotatable together with each other. The encoder disk 124 has light transmitting portions and light non-transmitting portions which are alternately arranged in a circumferential direction of the disk 124 and are equi-angularly spaced apart from each other in the circumferential direction. During rotation of the encoder disk 124 together with the shaft 28, a pulse signal is generated when each one of the light transmitting portions or each one of the light non-transmitting portions is detected by the optical sensor 125. The generated pulse signal is supplied to a controlling portion 130 described below. The controlling portion 130 is configured to detect, based on the pulse signal supplied from the rotary encoder 122, an amount of drive of the sheet supplying roller 25, i.e., an amount of rotation of the sheet supplying roller 25.

[Controlling Portion 130]

Figure 6:
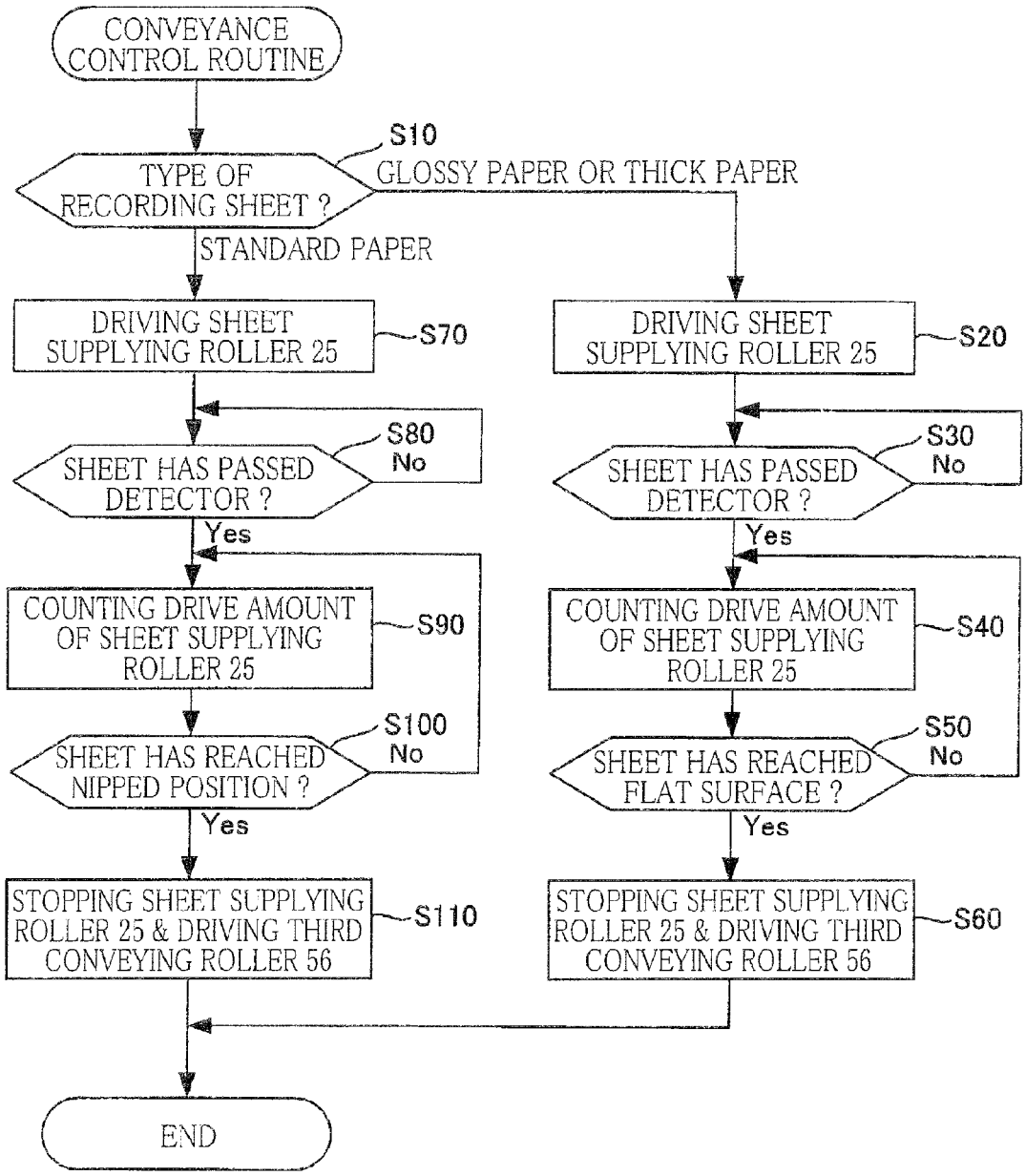
FIG. 6 is a flow chart of a conveyance control routine that is to be executed by the controlling portion 130.

There will be described an outline configuration of the controlling portion 130 (as an example of a controlling portion). The invention is realized by execution of a conveyance control routine (represented by a flow chart of FIG. 6) by the controlling portion 130.

As shown in FIG. 5, the controlling portion 130 is configured to control activations of the entirety of the compound machine 10. The controlling portion 130 is a microcomputer constituted principally by CPU 131, ROM 132, RAM 133, EEPROM 134 and ASIC 135 which are connected to one another via an internal bus 137.

The ROM 132 is provided for storing therein various programs, according to which the CPU 131 controls activations such as sheet conveyance performed in the compound machine 10. The RAM 133 is provided for serving as a working area or a storage area for temporarily storing various data therein. The EEPROM 134 is provided for storing therein setting information, flag or the like which is to be maintained even after power OFF of the compound machine 10.

The ASIC 135 has drive circuits for controlling the first and second drive motors 103, 102 which are connected to the ASIC 135. When each of the drive circuits of the ASIC 135 receives, from the CPU 131, a drive signal for rotating a corresponding one of the motors 103, 102, a drive current based on the drive signal is supplied from each of the drive circuits to the corresponding motor whereby the corresponding motor is rotated at a predetermined velocity in the forward or reverse direction. That is, the controlling portion 130 is configured to control the first and second drive motors 103, 102.

Further, to the ASIC 135, the pulse signal outputted by the rotary encoder 122 is supplied. The controlling portion 130 is configured to calculate amount of rotation of the sheet supplying roller 25, based on the pulse signal supplied from the rotary encoder 122.

Further, to the ASIC 135, there is connected the above-described light sensor 111 configured to output an analog electric signal (voltage signal or current signal) that is based on an intensity of the light received by the light receiving element. The outputted analog electrical signal is inputted to the controlling portion 130 in which it is judged whether an electric level (voltage value or current value) represented by the analog electrical signal is not lower than a predetermined threshold. When it is judged that the inputted analog electrical signal is not lower than the predetermined threshold, the signal is regarded as HIGH-level signal. When it is judged that the inputted analog electrical signal is lower than the predetermined threshold, the signal is regarded as LOW-level signal. Thus, the controlling portion 130 is configured to judge whether or not the leading end portion of the recording sheet has reached the detector 121.

The controlling portion 130 is configured to start counting the amount of rotation of the sheet supplying roller 25, at a point of time at which the controlling portion 130 judges that the leading end portion of the recording sheet has reached the detector 121. In this instance, the controlling portion 130 judges, based on the analog electrical signal supplied from the light sensor 111, that the leading end portion of the recording sheet has reached the detector 121. Then, the controlling portion 130 counts the amount of rotation of the sheet supplying roller 25, based on the pulse signal supplied from the rotary encoder 122. The controlling portion 130 is configured to determine a current position of the leading end portion of the recording sheet, based on a length of time having passed after the above-described point of time (at which the controlling portion 130 judges that the leading end portion of the recording sheet has reached the detector 121) and also the counted amount of rotation of the sheet supplying roller 25.

The determination of the current position of the leading end portion of the recording sheet does not necessarily have to be made according to the above-described method, but may be made according to other method. For example, the controlling portion 130 may be configured to start counting the amount of rotation of the sheet supplying roller 25, at a point of time at which the sheet supplying roller 25 starts to be rotated. In this modification, the controlling portion 130 can determine the current position of the leading end portion of the recording sheet, based on the amount of rotation which starts to be counted at the point of time of start of the rotation of the sheet supplying roller 25. Further, the leading end portion of the recording sheet may be determined based on a length of time that has passed from the point of time at which the sheet supplying roller 25 starts to be rotated. In these modifications, the detector 121 is not required for determining the current position of the leading end portion of the recording sheet.

[Conveyance Control by Controlling Portion 130]

In the printer unit 11 constructed as described above, the controlling portion 130 is configured to execute the conveyance control routine, for supplying a recording sheet and conveying the recording sheet along the sheet conveyance path 65. Referring to the flow chart of FIG. 7, there will be described the conveyance control routine as an example of procedure for controlling conveyance of the recording sheet.

When an image recording command (as an example of a command requesting start of conveyance of a sheet) is inputted to the compound machine 10 through an external device or an operator's control panel 18 (see FIG. 1), the conveyance control routine is initiated with step S10 in which the controlling portion 130 determines a type of the recording sheet that is to be subjected to an image recording by the image recording command. For example, before the image recording command is inputted to the compound machine 10, the controlling portion 130 may make a reference to information (corresponding to information representing type of the sheet) representing whether the recording sheet (that is held in the sheet supply tray 20 and is to be subjected to the image recording) is a standard paper, a glossy paper or a thick paper. This information may be included in the image recording command, or may be inputted, independently of the image recording command, via the operator's control panel 18 or the like, by a user. It is noted that, when this information representing type of the sheet is not yet inputted to the compound machine 10, the controlling portion 130 causes the operator's control panel 18 to display a message requesting the information to be inputted.

When it is judged in step S10 by the controlling portion 130 that the recording sheet is a glossy paper or a thick paper, the control flow goes to step S20 in which the controlling portion 130 causes the second drive motor 102 to be rotated in the forward direction whereby the sheet supplying roller 25 is rotated. In this instance, although the third conveying roller 56 is placed in its stop state, the third conveying roller 56 is freely rotatable. Thus, by implementation of step S20, the recording sheet is conveyed by the sheet supplying roller 25 toward the third pairs of rollers 55. When the recording sheet becomes nipped by the third pairs of rollers 55, even if the third conveying roller 56 is not being rotated by the second drive motor 102, the recording sheet can be further conveyed by the sheet supplying roller 25.

Then, in step S30, the controlling portion 130 judges whether or not the conveyed recording sheet has passed the detector 121. This judgment is made based on the level of the signal supplied from the light sensor 111, as described above.

When it is judged in step S30 that the recording sheet has passed the detector 121, namely, when a positive judgment (YES) is obtained in step S30, the control flow goes to step S40 that is implemented to count or calculate an amount of rotation of the sheet supplying roller 25. This count or calculation of the amount of rotation of the sheet supplying roller 25 is made based on the pulse signal supplied from the rotary encoder 122.

In this step S40, the controlling portion 130 calculates an amount of conveyance of the recording sheet since the recording sheet has passed the detector 121. This calculation of the conveyance amount is made based on the amount of rotation of the sheet supplying roller 25 from the point of time at which it is judged in step S30 that the recording sheet has passed the detector 121. Then, in step S50, the controlling portion 130 judges whether the conveyance amount is larger than a distance from the position of the detector 121 to the position of the flat surface 22 (e.g., a distance from a nipped position in which the recording sheet is nipped by the third pairs of rollers 55, to a downstream-side position which is located on a downstream side of the nipped position and which is distant from the nipped position by a predetermined distance). It is noted that the controlling portion 130 may judge whether the conveyance amount is larger than a distance larger than the above-described distance (from the position of the detector 121 to the position of the flat surface 22) by a predetermined amount.

When the conveyance amount is larger than the above-described distance (from the position of the detector 121 to the position of the flat surface 22), it is judged by the controlling portion 130 in this step S50 that the leading end portion of the recording sheet has reached the flat surface 22, namely, a positive judgment (YES) is obtained in this step S50. When the positive judgment (YES) is obtained in step S50, the control flow goes to step S60 in which the rotation of the second drive motor 102 is switched from the forward direction to the reverse direction whereby rotation of the sheet supplying roller 25 is stopped while the third conveying roller 56 is rotated by the second drive motor 102. Thereafter, the recording sheet is conveyed by the third pairs of rollers 55. The set of procedures performed in steps S10 through S60 is an example of a first mode. It is noted that, although the rotation of the sheet supplying roller 25 is stopped in step S60 in the present first embodiment, the rotation of the sheet supplying roller 25 may not be stopped in step S60. In this modification, the sheet supplying roller 25 is rotated while the third conveying roller 56 is not rotated by the second drive motor 102 until step S50 (i.e., until the leading end portion of the recording sheet reaches the flat surface 22), and then the third conveying roller 56 as well as the sheet supplying roller 25 is rotated by the second drive motor 102.

On the other hand, when it is judged in step S10 by the controlling portion 130 that the recording sheet is a standard paper, the controlling portion 130 implements steps S70-110, among which steps S70-S90 are the same as the above-described steps S20-S40.

In step S90, the controlling portion 130 calculates an amount of conveyance of the recording sheet since the recording sheet has passed the detector 121. This calculation of the conveyance amount is made based on the amount of rotation of the sheet supplying roller 25 from the point of time at which it is judged in step S80 that the recording sheet has passed the detector 121. Then, in step S100, the controlling portion 130 judges whether the conveyance amount is larger than a distance from the position of the detector 121 to the nipped position in which the recording sheet is nipped by the third pairs of rollers 55. It is noted that the controlling portion 130 may judge whether the conveyance amount is larger than a predetermined distance larger than the above-described distance (from the position of the detector 121 to the nipped position) by a predetermined amount, as long as the predetermined distance is smaller than a distance from the position of the detector 121 to the position of the flat surface 22.

When the conveyance amount is larger than the above-described distance (from the position of the detector 121 to the nipped position), it is judged by the controlling portion 130 in this step S100 that the leading end portion of the recording sheet has reached the nipped position in which the leading end portion of the sheet is nipped by the third pairs of rollers 55, namely, a positive judgment (YES) is obtained in this step S100. When the positive judgment (YES) is obtained in step S100, the control flow goes to step S110 in which the rotation of the second drive motor 102 is switched from the forward direction to the reverse direction whereby rotation of the sheet supplying roller 25 is stopped while the third conveying roller 56 is rotated by the second drive motor 102. Thereafter, the recording sheet is conveyed by the third pairs of rollers 55. The set of procedures performed in steps S10 and S70 through S110 is an example of a second mode.

As described above, the controlling portion 130 is configured to carry out a selected one of the first and second modes which is selected based on information representing type of the recording sheet held in the sheet supply tray 20. In other words, the controlling portion 130 is configured to control the sheet supplying roller 25 and the third conveying roller 56, in accordance with a selected one of first and second modes, which is selected based on the information representing type of the sheet.

The recording sheet, having been conveyed in accordance with the selected first or second mode, is conveyed by the first pairs of rollers 58, and is subjected to an image recording performed by the recording portion 24. After having been subjected to the image recording, the recording sheet is conveyed by the second pairs of rollers 59 so as to be discharged to the sheet exit tray 21.

Effects of First Embodiment

In the above-described first embodiment, the outside guide surface 17A includes the flat surface 22 which is provided on the immediately downstream side, as viewed in the sheet conveyance direction, of the position 17B in which the third conveying roller 56 is disposed, such that the flat surface 22 extends from the position 17B toward the straight path section 67. In other words, the outside guide surface 17A includes a non-curved portion in its portion that cooperates with a corresponding portion of the inside guide surface 19A to define the curved path section 66 therebetween. The recording sheet having passed the third conveying roller 56 is caused to collide at its leading end portion with the flat surface 22. After collision with the flat surface 22, the recording sheet has be conveyed in a direction that is changed to become parallel with the flat surface 22. Upon change of the direction of the recording sheet, the recording sheet receives an opposite force acting in a direction opposite to the sheet conveyance direction in which the sheet is to be conveyed. However, once after the direction of the recording sheet has been changed, the recording sheet is conveyed with only its leading end portion (i.e., its leading end and vicinity of the leading end) being in contact with the flat surface 22. That is, an area of a surface of the recording sheet, which is in contact with the flat surface 22, is small, so that the opposite force applied from the flat surface 22 to the recording sheet is small.

In the above-described first embodiment, the recording sheet is conveyed by the sheet supplying roller 25 at least upon change of the direction of the recording sheet, i.e., upon increase of the opposite force acting in the direction opposite to the sheet conveyance direction. In this instance, there is a risk that the rolling surface of the sheet supplying roller 25, which is in contact with a surface of the recording sheet, could slip on the surface of the recording sheet. However, even in occurrence of the slipping, the quality of the image recorded on the recording sheet by the recording portion 24 can be satisfactorily maintained, by the following reasons.

Firstly, in the above-described first embodiment, the sheet supplying roller 25 is to be in contact with a bottom face of the recording sheet, i.e., the above-described other of the opposite side surfaces of the recording sheet which faces the inside guide surface 19A, while the third conveying roller 56 is to be in contact with a top face of the recording sheet, i.e., the above-described one of the opposite side surfaces of the recording sheet which faces the outside guide surface 17A, and the recording portion 24 is configured to record image onto the top face of the recording sheet, i.e., the face of the recording sheet which faces the outside guide surface 17A. That is, the sheet supplying roller 25 is to be in contact with the bottom face of the recording sheet that is opposite to the top face of the recording sheet onto which the image is to be recorded.

Further, in the above-described first embodiment, the recording sheet is conveyed by the third pairs of rollers 55 after the change of the direction of the recording sheet, namely, after the opposite force (acting in the direction opposite to the sheet conveyance direction) becomes small. Therefore, there is a low possibility that the rolling surface of the third conveying roller 56 of each third pair of rollers 55 slips on the surface of the recording sheet, so that the quality of the image recorded on the surface of the recording sheet by the recording portion 24 can be satisfactorily maintained.

It is common that the opposite force (applied from the outside guide surface 17A to the recording sheet and acting in the direction opposite to the sheet conveyance direction) is larger where the recording sheet conveyed along the sheet conveyance path 65 is a thick paper (having a rigidity higher than that of a standard paper) than where the recording sheet conveyed along the sheet conveyance path 65 is a standard paper. Therefore, where a thick paper as the recording sheet is conveyed, the rolling surface of the third conveying roller 56 could slip on the surface of the recording sheet, with a higher possibility than where a standard paper as the recording sheet is conveyed. Further, where the recording sheet conveyed along the sheet conveyance path 65 is a glossy paper or other paper having a special coating disposed on its surface (onto which image is to be recorded), the coating could be negatively affected by contact with the rolling surface of the third conveying roller 56 if the rolling surface is deteriorated, so that there is a risk that the quality of the image recorded on the coated surface of the recording sheet could be negatively affected.

On the other hand, where the recording sheet conveyed along the sheet conveyance path 65 is a standard paper or other paper having a low rigidity, the above-described possibilities or risks of slipping of the rolling surface on the surface of the recording sheet and reduction of the image recorded on the surface of the recording sheet are low. Therefore, when the leading end portion of the recording sheet is positioned in the nipped position in which the recording sheet is to be nipped by the third pairs of rollers 55, if the recording sheet is conveyed by the sheet supplying roller 25 (that is located in an upstream side of the third conveying roller 56) rather than the third conveying roller 56, there would be arisen a problem that the direction of the recording sheet is likely to be unstable because the leading end portion of the recording sheet is considerably distant from the sheet supplying roller 25. The instability of the direction of the recording sheet could increase a possibility of jamming of the recording sheet in the sheet conveyance path 65.

In the above-described first embodiment, in view of the above tendencies, the controlling portion 130 is configured to carry out a selected one of the first and second modes which is selected based on information representing type of the recording sheet held in the sheet supply tray 20. For example, in a case where a recording sheet having a high rigidity or a special coating is to be conveyed along the sheet conveyance path 65, the first mode is selected to be carried out, whereby it is possible to reduce the possibilities of slipping of the rolling surface on the recording sheet surface and reduction of the image recorded on the recoding sheet surface. Further, in a case where a recording sheet having a low rigidity is to be conveyed along the sheet conveyance path 65, the second mode is selected to be carried out whereby the conveyance of the recording sheet onto a downstream side of the third pairs of rollers 55 is made by the third conveying roller 56 (that is closer to the leading end portion of the recording sheet then the sheet supplying roller 25) rather than by the sheet supplying roller 25. It is therefore possible to reduce the possibility of jamming of the recording sheet in the sheet conveyance path 65.

Further, in the above-described first embodiment, the judging portion 120 includes the detector 121 and the rotary encoder 122, so that the controlling portion 130 is capable of detecting or determining the leading end portion of the recording sheet, since the controlling portion 130 is configured to detect or determine the leading end portion of the recording sheet, based on the amount of drive or rotation of the sheet supplying roller 25, which is measured or detected by the rotary encoder 122 after detection of the leading end portion of the recording sheet by the detector 121.

Further, in the above-described first embodiment, the third conveying roller 56 and the sheet supplying roller 25 are to be driven or rotated by a common drive source in the form of the second drive motor 102. Owing to this arrangement, the number of the drive sources that have to be provided in the compound machine 10 can be reduced. Consequently, the compound machine 10 as a whole can be constructed compact in size, and the cost required for manufacturing the compound machine 10 can be reduced.

Further, in the above-described first embodiment, the flat surface 22 is provided on the immediately downstream side of the position 17B in which the third conveying roller 56 is disposed, as described above. Owing to the provision of the flat surface 22, as shown in FIG. 17B, a direction or angle of the leading end portion of the recording sheet with respect to the straight path section 67 is changed largely in the vicinity (that is marked by circle LC in FIG. 17B) of an upstream end, as viewed in the sheet conveyance direction, of the flat surface 22. That is, in the above-described first embodiment, the large change of the angle of the leading end portion of the recording sheet takes place in an early period of the stage of the conveyance from the position 17B (in which the third conveying roller 56 is disposed) to the straight path section 67, and a rate of the change of the angle of the leading end portion of the recording sheet is gradually reduced as the leading end portion of the recording sheet is conveyed away from the position 17B toward the straight path section 67. Since the resistance or opposite force (acting in the direction opposite to the sheet conveyance direction) is generated based on the change of the angle of the leading end portion of the recording sheet, the recording sheet is conveyed by the sheet supplying roller 25 (rather than by the third conveying roller 56) until the large change of the angle of the leading end portion of the recording sheet has already taken place. The top face (onto which image is to be formed) of the recording sheet is not damaged by the sheet supplying roller 25 that is in contact with the bottom face of the recording sheet rather than with the top face of the recording sheet.

Figure 17A:
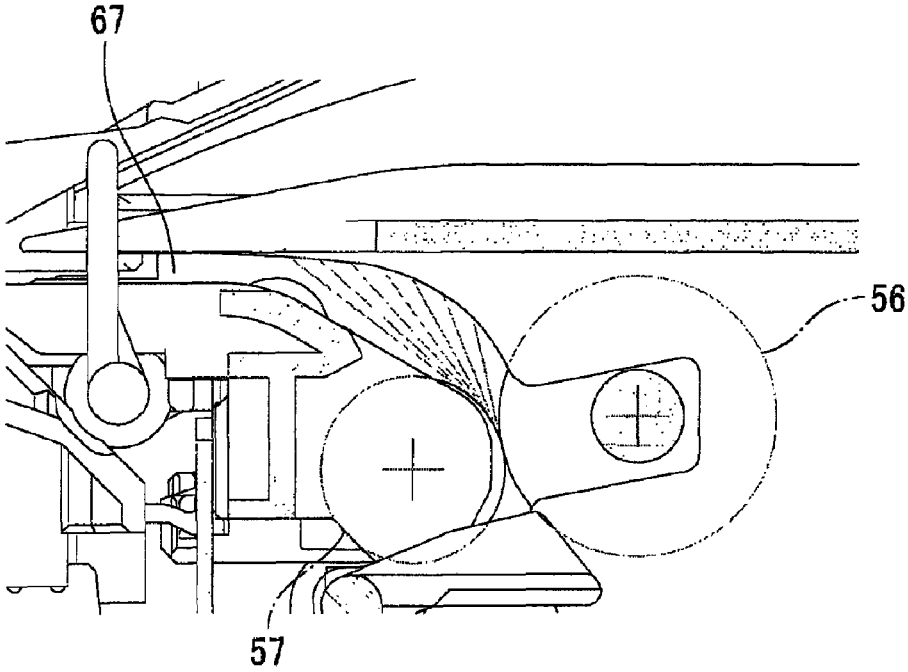
FIG. 17A is a view showing a boundary between a curved path section 66 and a straight path section 67 of a sheet conveyance path 65, wherein a flat surface is not provided in the curved path section 66.
Figure 17B:
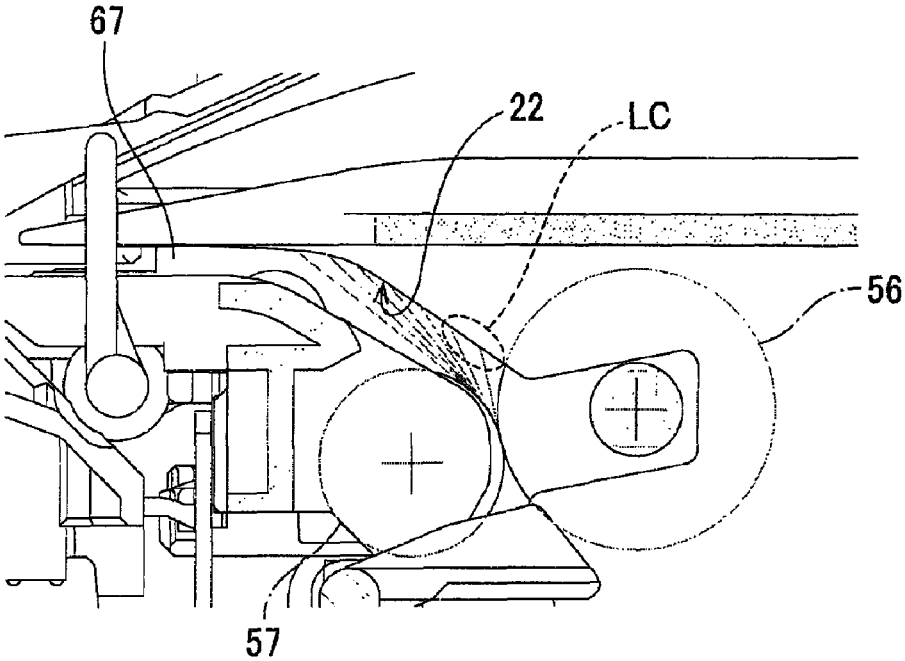
FIG. 17B is a view showing the boundary between the curved path section 66 and the straight path section 67 of the sheet conveyance path 65, wherein the flat surface 22 is not provided in the curved path section 66.

On the other hand, in an arrangement, as shown in FIG. 17A, in which the entirety of the outside guide surface 17A of the outside guide member 17 is curved without provision of a flat portion in the outside guide surface 17A, the large change of the angle of the leading end portion of the recording sheet takes place in a final or intermediate period (rather than in an early period) of the stage of the conveyance from the position (in which the third conveying roller 56 is disposed) to the straight path section 67, and the rate of the change of the angle of the leading end portion of the recording sheet is gradually increased as the leading end portion of the recording sheet is conveyed away from the position 17B toward the straight path section 67. Since the opposite force is generated based on the change of the angle of the leading end portion of the recording sheet, if the recording sheet is conveyed by the third conveying roller 56 (that is made of a rubber, for example) which is disposed outside of the sheet conveyance path 65 and which is in contact with the top face of the recording sheet, there is a risk that the top surface could be scratched or damaged.

Figure 8:
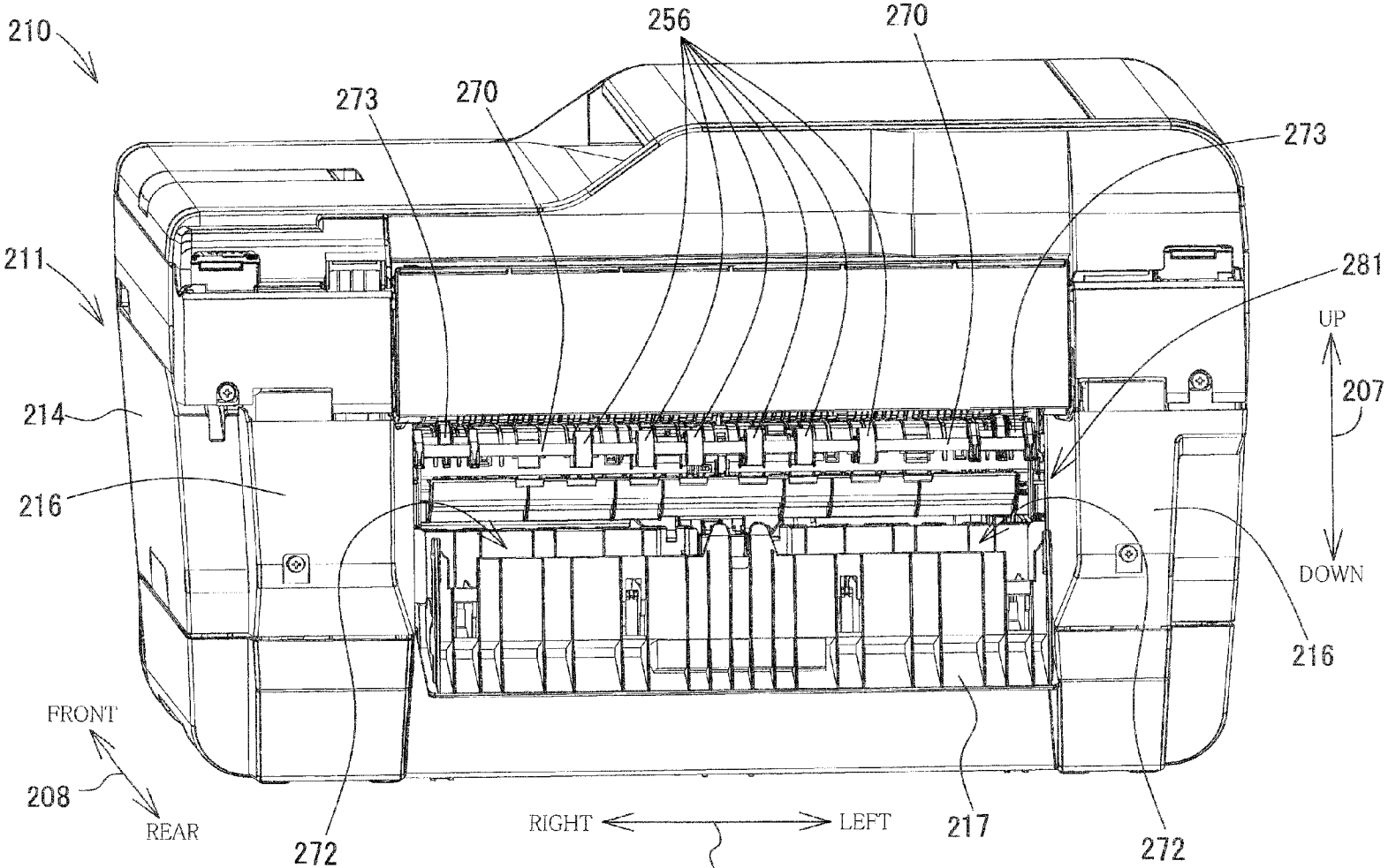
FIG. 8 is a perspective view of a compound machine 210 that is constructed according a first embodiment of the invention.

Referring next to FIGS. 8, 9, 10, 11, 12A, 12B, 12C, 13, 14, 15, 16A and 16B, there will be described a second embodiment of the invention. It is noted that, in the following description, there will be used terms "upper", "lower", "right", "left", "front" and "rear" directions of a compound machine 210 which are directions as seen in FIG. 8, and which are indicated by respective arrows "UP", "DOWN", "RIGHT", "LEFT", "FRONT" and "REAR" in the drawings.

[Compound Machine 210]

As shown in FIG. 8, the compound machine 210, which is an example of an image recording apparatus according to the invention, has a generally rectangular parallelepiped body with a low profile. An outside guide member 217 is provided in a rear portion of the machine 210, and a inkjet-type printer unit 211 is provided in a rear portion of the machine 210. The compound machine 210 has various functions such as facsimile and printer functions. In the present second embodiment, although the printer unit 211 is capable of performing an one-side recording operation, the printer unit 211 may be modified to have a function of performing a both-side recording operation. The printer unit 211 has a housing body 214 in which a front opening (not shown) opens in its front face, so that a sheet supply tray 220 (as an example of a tray) and a sheet exit tray 221 can be introduced into and removed from an inner space of the machine 210 via the opening, by moving the trays 220, 221 in a front-rear direction indicated by arrows 208. In the sheet supply tray 220, recording sheets (as examples of sheets) of desired sizes can be held or stacked. It is noted that arrows 207 indicate an up-down direction and that arrows 209 indicate a right-left direction.

Figure 9:
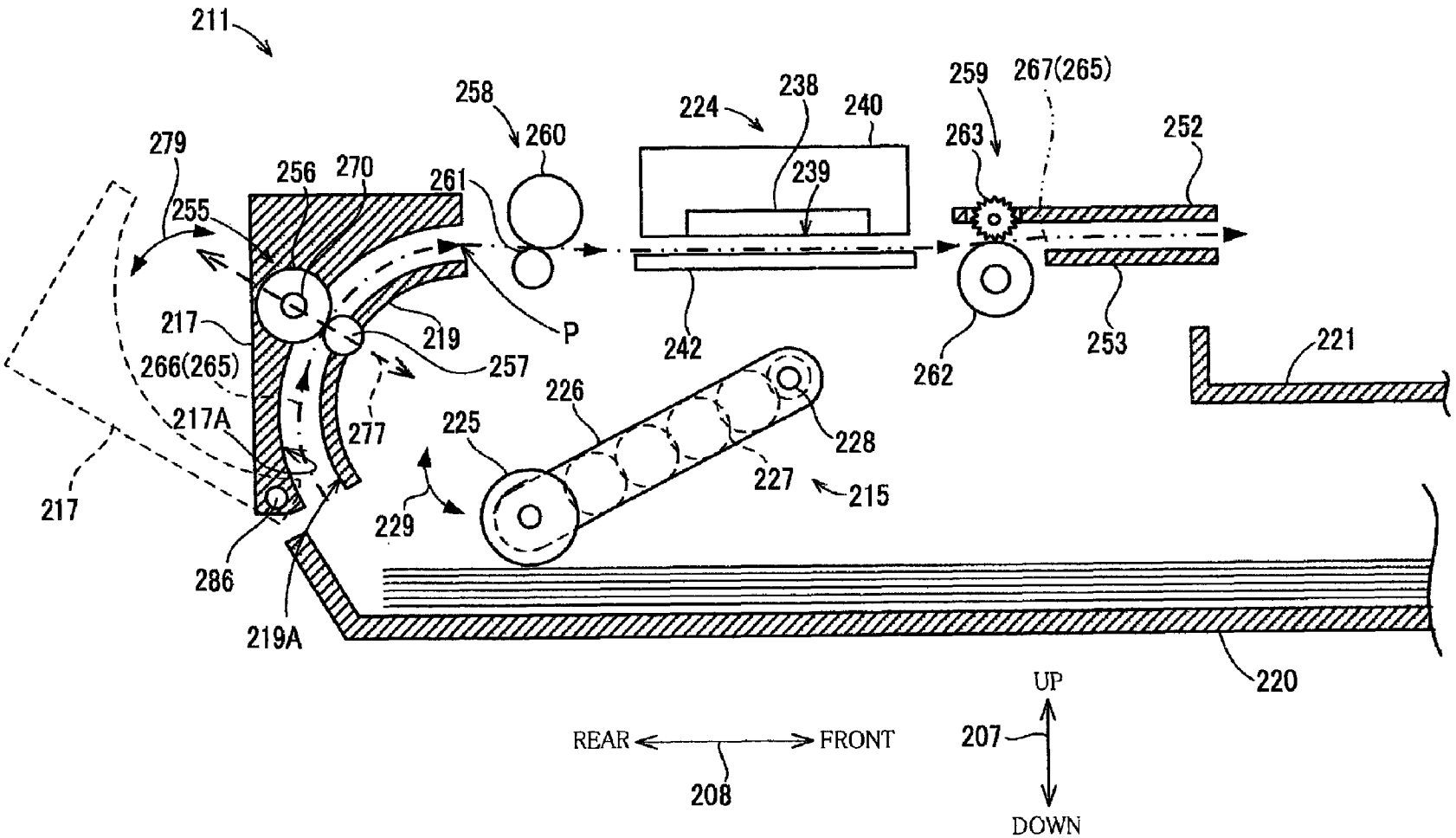
FIG. 9 is a cross sectional view schematically showing an internal construction of a printer unit 211 that is included in the compound machine 210.

As shown in FIG. 9, the printer unit 211 includes a sheet supplying portion 215 configured to supply the recording sheets, and a recording portion 224 (as an example of a recording portion) configured to record image on each of the recording sheets by ejecting ink onto each recording sheet. Thus, the printer unit 211 is configured to record, on the recording sheet, image based on a print data transmitted from an external device. It is noted that a sheet guide member 273, a recessed portion 272 and a flat surface 222 (which will be described below) are not illustrated in FIG. 9.

The compound machine 210 includes a conveying device (as an example of a conveying device). The conveying device includes at least a curved path section 266, frames 271, a shaft 270, third conveying rollers 256, pinch rollers 257, sheet guide members 273 and an outside guide member 217, which are described below. Further, the conveying device may include a straight path section 267.

[Sheet Supplying Portion 215]

As shown in FIG. 9, the sheet supplying portion 215 is located on an upper side of the sheet supply tray 220. The sheet supplying portion 215 includes a sheet supplying roller 225 (as an example of a supplying roller), a pivotable arm 226 and a first drive-force transmitting mechanism 227 (as an example of a first transmission mechanism) that is constituted principally by a plurality of gears meshing with each other. The sheet supplying roller 225 is held at its shaft by a distal end portion of the pivotable arm 226. The pivotable arm 226 is pivotable about a shaft 228 (that is provided in a proximal end portion of the arm 226) in directions indicated by arrows 229. With pivot motion of the arm 226, the sheet supplying roller 225 can be brought into contact with the sheet supply tray 220 and can be separated from the sheet supply tray 220, namely, the sheet supplying roller 225 can be displaced toward and away from the sheet supply tray 220. Thus, the sheet supplying roller 225 can be brought into contact with the recording sheet held in the sheet supply tray 220. The sheet supplying roller 225 is rotatable by a drive force that is transmitted from a second drive motor 302 (as an example of a drive source) (see FIGS. 13 and 14) via the first drive-force transmitting mechanism 227. The sheet supplying roller 225 is to be held in contact with an uppermost one of the recording sheets stacked in the sheet supply tray 220, and is configured to separate the uppermost sheet from the other sheets so as to supply the sheet to the curved path section 266 (as an example of a first conveyance path section and as an example of a curved conveyance path) of a sheet conveyance path 265.

[Sheet Conveyance Path 265]

As shown in FIG. 9, the printer unit 211 defines therein the sheet conveyance path 265 (as an example of a conveyance path) which is configured to guide the recording sheet to be conveyed from an end (i.e., rear end portion) of the sheet supply tray 220 to the sheet exit tray 221 via the recording portion 224.

The sheet conveyance path 265 is sectioned into the above-described curved path section 266 extending from the end of the sheet supply tray 220 to first pairs of rollers 258, and a straight path section 267 (as an example of a second or third conveyance path section and as an example of a straight path section) extending from the first pairs of rollers 258 to the sheet exit tray 221 via a region right below the recording portion 224. That is, in the sheet conveyance path 265, the curved path section 266 and the straight path section 267 are disposed.

[Curved Path Section 266]

The curved path section 266 is a curved path extending from a vicinity of the end of the sheet supply tray 220 to the first pairs of rollers 258 (i.e., to a position indicated by "P" in FIG. 9). While being in the curved path section 266, the recording sheet is caused to be bent and guided so as to be conveyed curvedly along a sheet conveyance path (indicated by one-dot chain line in FIG. 9) in a sheet conveyance direction (indicated by arrows disposed on the one-dot chain line in FIG. 9). The curved path section 266 and the straight path section 267 are connected to each other in the position P. Thus, the recording sheet is guided by the curved path section 266 to the straight path section 267 which is located on a downstream side, as viewed in the sheet conveyance direction, of the curved path section 266. The curved path section 266 is defined between an inside guide member 219 and an outside guide member 217 which are opposed to each other and are spaced apart from each other by a predetermined distance. In other words, the curved path section 266 is defined between an inside guide surface 219A (as an example of an inside guide surface) and an outside guide surface 217A (as an example of an outside guide surface) which are constituted by a rear surface of the inside guide member 219 and a front surface of the outside guide member 217, respectively.

Figure 10:
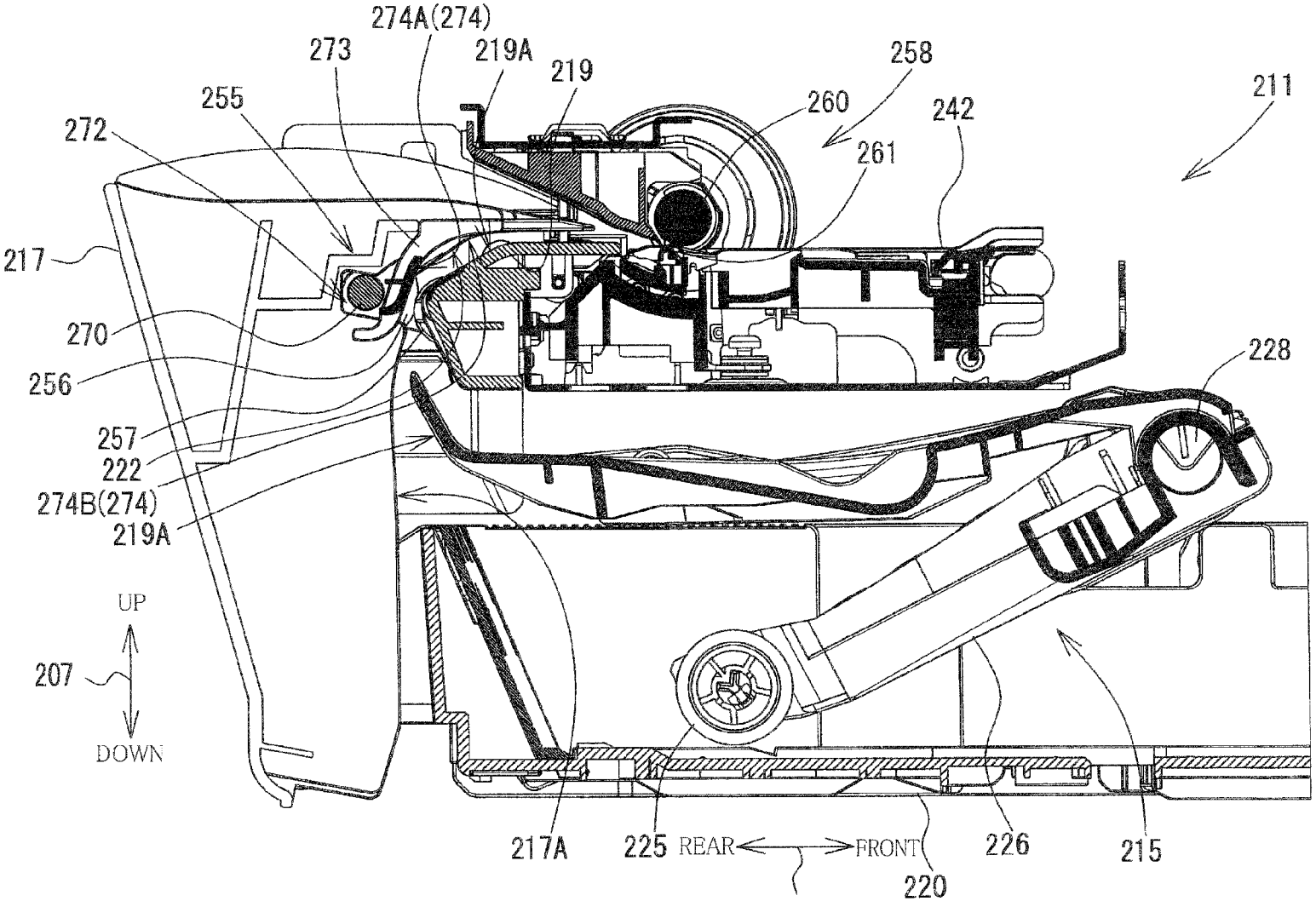
FIG. 10 is a cross sectional view showing the internal construction of the printer unit 211.

Like in the above-described first embodiment, in the present second embodiment, as shown in FIGS. 10 and 17B, the outside guide surface 217A includes a flat surface 222 (as an example of a sheet supporting portion constituted by a flat surface) which is provided on an immediately downstream side, as viewed in the sheet conveyance direction, of a position in which the third conveying roller 256 is disposed. It is noted that, in the present second embodiment, the outside guide member 217 is pivotable so that a posture of the outside guide member 217 is changeable, as described below.

[Straight Path Section 267]

The straight path section 267 is a straight path extending in the front-rear direction 208 from the position P, i.e., a downstream end, as viewed in the sheet conveyance direction, of the curved path section 266 to the sheet exit tray 221. That is, the straight path section 267 is contiguous to the curved path section 266, and is located on a downstream side, as viewed in the sheet conveyance direction, of the curved path section 266. While being in the straight path section 267, the recording sheet is caused to be guided so as to be conveyed straightly along the sheet conveyance path (indicated by two-dot chain line in FIG. 9) in the sheet conveyance direction (indicated by arrows disposed on the two-dot chain line in FIG. 9). After being subjected to a recording operation carried out by the recording portion 224, the sheet is discharged to the sheet exit tray 221. The recording portion 224 faces a region of the straight path section 267 which is defined between the recording portion 224 and a platen 242 that are opposed to each other and spaced apart from each other by a predetermined distance. Another region of the straight path section 267, which the recording portion 224 does not face, is defined between an upper-side guide member 252 and a lower-side guide member 253 that are opposed to each other and spaced apart from each other by a predetermined distance.

[Outside Guide Member 217]

As shown in FIGS. 8-10, an outside guide member 217 (as an example of an outside guide member and as an example of a second member) is attached to a back face 216 (that is opposite to the front face) of the housing body 214 of the compound machine 210. Described specifically, as shown in FIG. 8, a rear opening 281 is provided to open in the back face 216 such that the rear opening 281 is positioned in a position generally corresponding to a position of the above-described front opening of the front face of the housing body 214. The outside guide member 217 is attached to the back face 216 such that the rear opening 281 is closed by the outside guide member 217. As described above, the outside guide surface 217A is constituted by a front surface of the outside guide member 217.

As shown in FIG. 9, the outside guide member 217 is pivotable in directions indicated by arrows 279, about a shaft 286 which is located in vicinity of a lower end in the up-down direction 207 and which extends in the right-left direction 209 (that is perpendicular to drawing sheet of FIG. 9). With the pivot motion of the outside guide member 217, the posture of the outside guide member 217 is changeable so that the outside guide member 217 takes selectively a closing posture (corresponding to a second posture) and an exposing posture (corresponding to a first posture). The closing posture is indicated by solid line in FIG. 9 and is shown by FIG. 10. The exposing posture is indicated by broken line in FIG. 9 and is shown by FIG. 8.

When the outside guide member 217 takes the closing posture, the inside guide surface 219A, which defines the curved path section 266, is covered by the outside guide member 217 so as to be isolated from an exterior of the compound machine 210. In this instance, the outside guide surface 217A defines the curved path section 266, so as to guide the recording sheet. On the other hand, when the outside guide member 217 takes the exposing posture, the inside guide surface 219A is exposed to the exterior of the compound machine 210 from a rear side of the compound machine 210. In this instance, the outside guide surface 217A is inclined backwardly, without defining the curved path section 266, so as not to guide the recording sheet. That is, the recording sheet is guided by the curved path section 266 when the outside guide member 217 takes the closing posture.

As shown in FIGS. 8 and 10, a recessed portion 272 (as an example of a recessed portion) is provided in the outside guide surface 217A of the outside guide member 217 so as to extend in the right-left direction 209. The recessed portion 272 has a shape that allows the third conveying rollers 256 and the shaft 270 (on which the rollers 256 are mounted) to be received in the recessed portion 272. Thus, the third conveying rollers 256 and the shaft 270 are not in contact with the outside guide surface 217A, since the third conveying rollers 256 and the shaft 270 are received in the recessed portion 272 when the outside guide member 217 takes the closing posture.

It is noted that, in the present second embodiment, the posture of the outside guide member 217 is changed by the pivot motion of the outside guide member 217. However, the posture of the outside guide member 217 may be changed by any other method. For example, the outside guide member 217 may be arranged to take selectively the closing posture and the exposing posture, by selectively attaching and removing the outside guide member 217 to and from the compound machine 210.

[Recording Portion 224]

As shown in FIG. 9, the recording portion 224 is disposed on an upper side of the straight path section 267 of the sheet conveyance path 265. The recording portion 224 includes a recording head 238 and a carriage 240 which carries the recording head 238 and which is to be reciprocated in a main scanning direction (i.e., direction perpendicular to drawing sheet of FIG. 9). The recording head 238 is configured to receive inks that are to be supplied from ink cartridges (not shown), and to eject the inks in the form of small ink droplets through nozzles 239. With the carriage 240 being reciprocated in the main scanning direction, the recording head 238 is caused to scan the recording sheet, whereby image is recorded onto the recording sheet which is supported on the platen 242 while being conveyed along the sheet conveyance path. It is noted that the platen 242 is disposed on a lower side of the straight path section 267 and is opposed to the recording portion 224.

[First Pairs of Rollers 258 & Second Pairs of Rollers 259]

As shown in FIG. 9, the first pairs of rollers 258 are disposed on an upstream side, as viewed in the sheet conveyance direction, of the recording portion 224. Each pair of the first pairs of rollers 258 consist of a first conveying roller 260 which is disposed on an upper side of the sheet conveyance path 265 (i.e., upper side of the straight path section 267) and a pinch roller 261 which is disposed on a lower side of the sheet conveyance path 265 (i.e., lower side of the straight path section 267). The pinch roller 261 is biased by a biasing member (not shown) such as a spring, and is held in pressing contact with a rolling surface of the first conveying roller 260. The first pairs of rollers 258 are configured to nip the recording sheet, and to feed the recording sheet onto the platen 242.

Further, as shown in FIG. 9, second pairs of rollers 259 are disposed on a downstream side, as viewed in the sheet conveyance direction, of the recording portion 224. Each pair of the second pairs of rollers 256 consist of a second conveying roller 262 which is disposed on a lower side of the sheet conveyance path 265 (i.e., lower side of the straight path section 267) and a spur roller (rowel) 263 which is disposed on an upper side of the sheet conveyance path 265 (i.e., upper side of the straight path section 267). The spur roller 263 is biased by a biasing member (not shown) such as a spring, and is held in pressing contact with a rolling surface of the second conveying roller 262. The second pairs of rollers 259 are configured to nip the recording sheet having passed the recording portion 224, and to convey the recording sheet to the sheet exit tray 221.

Figure 14:
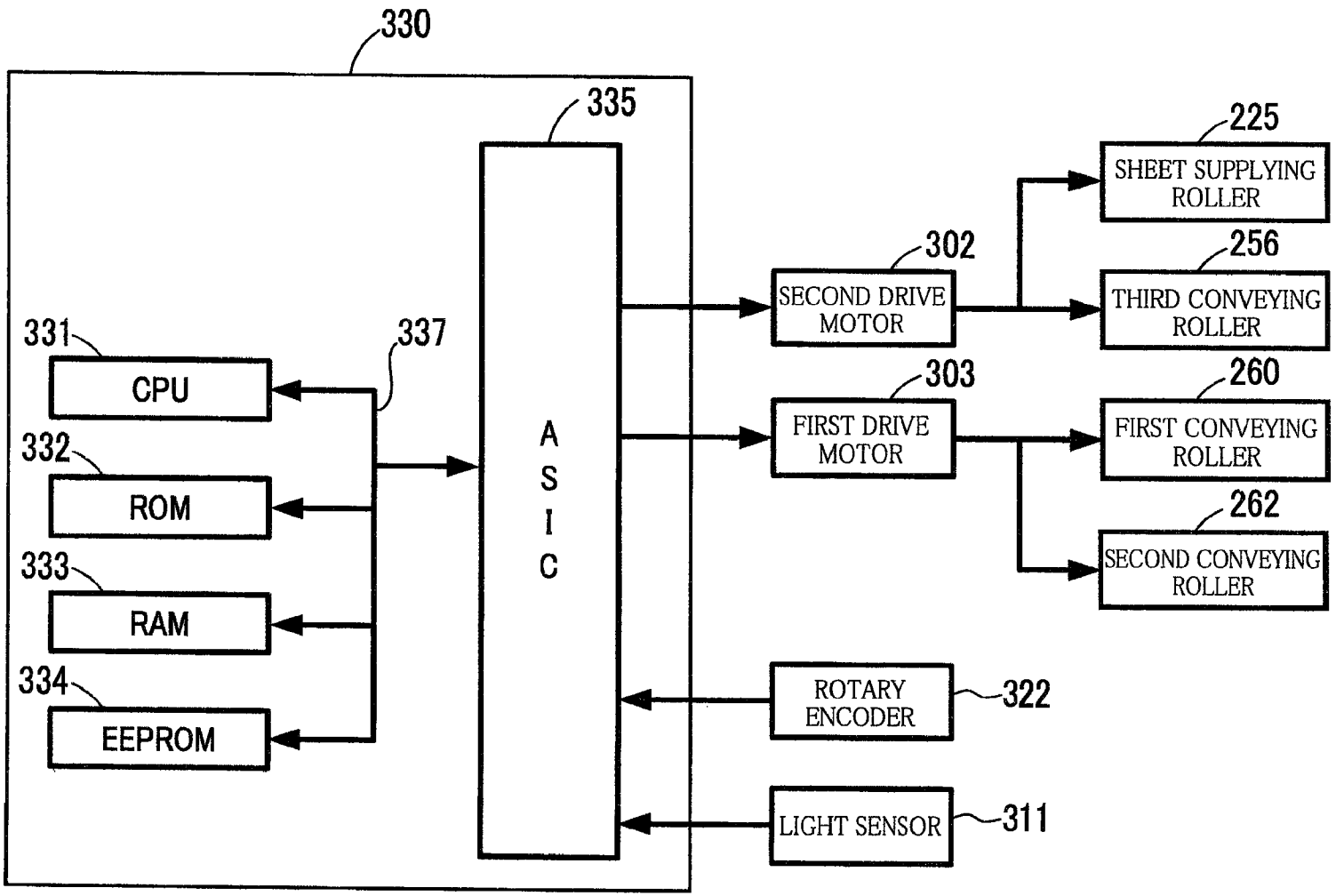
FIG. 14 is a block diagram showing a construction of a controlling portion 330 included in the compound machine 210.

Each of the first and second conveying rollers 260, 262 can be rotated by a rotary drive force that is to be transmitted thereto from a first drive motor 303 (see FIG. 14). When the first drive motor 303 is rotated in one of forward and reverse directions, the recording sheet is conveyed in the sheet conveyance direction.

[Third Pairs of Rollers 255]

As shown in FIG. 9, third pairs of rollers 255 (each pair of which is as an example of a pair of conveying rollers) are disposed on an upstream side, as viewed in the sheet conveyance direction, of the first pairs of rollers 258. Each pair of the third pairs of rollers 255 consist of a third conveying roller 256 (as an example of a drive roller and an example of a first roller) which is disposed on a side of the outside guide surface 217A and a pinch roller 257 (as an example of a driven roller and an example of a second roller) which is disposed on a side of the inside guide surface 219A. Each pinch roller 257 is opposed to the corresponding third conveying rollers 256, and is biased by a biasing member (not shown) such as a spring so as to be held in pressing contact with a rolling surface of the corresponding third conveying roller 256. The third pairs of rollers 255 are configured to nip the recording sheet and to convey the recording sheet toward the first pairs of rollers 258.

Figure 13:
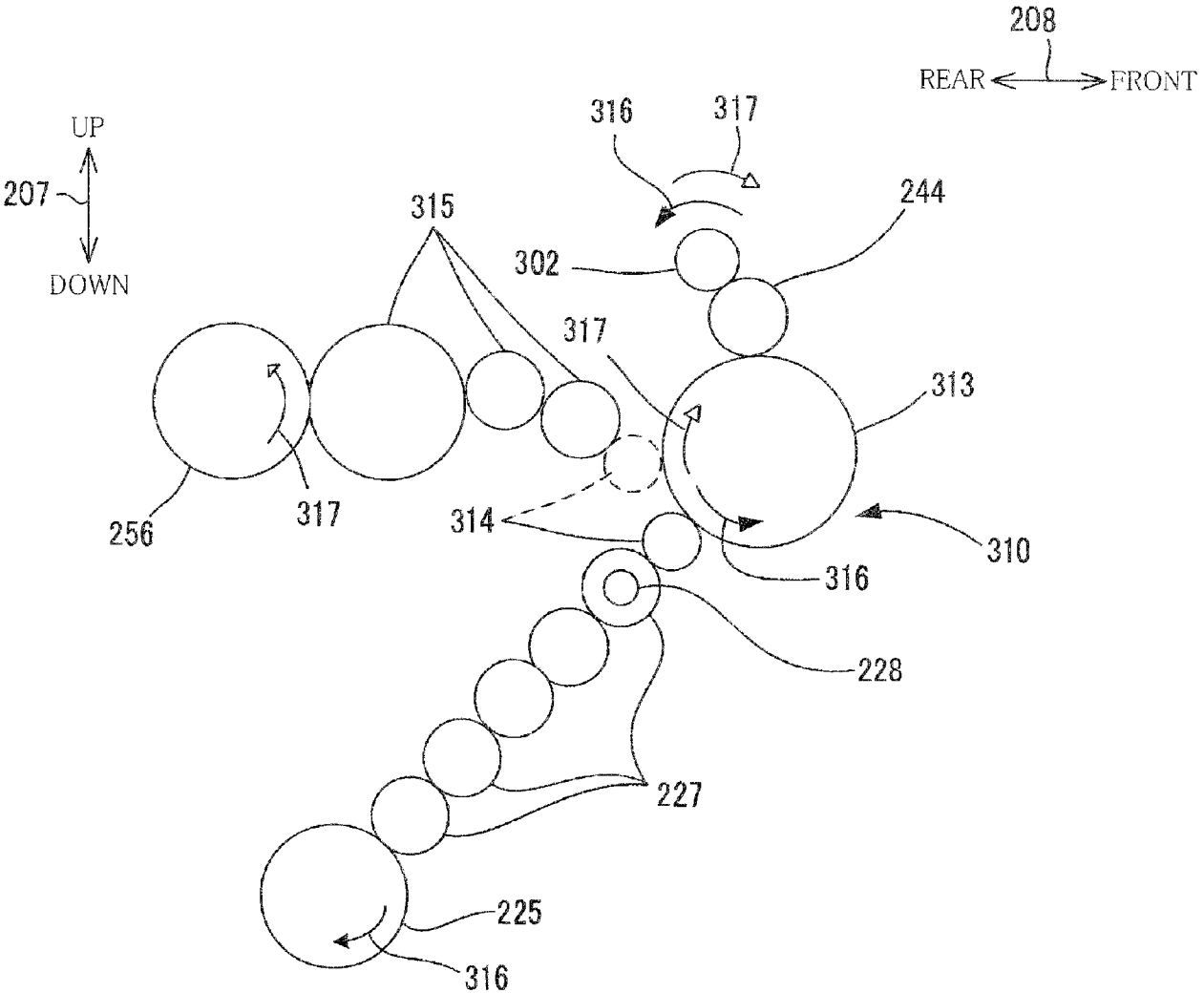
FIG. 13 is view schematically showing a transmission selector 310 and first and second drive-force transmission mechanisms 227, 315 that are included in the compound machine 210.

As shown in FIG. 13, the sheet supplying roller 225 is rotated when a rotary drive force is transmitted thereto from the second drive motor 302 via a transmission selector 310 (as an example of a transmission selector) and the first drive-force transmitting mechanism 227, namely, when the transmission selector 310 selects the first drive-force transmitting mechanism 227 for thereby causing the rotary drive force to be transmitted via the selected first drive-force transmitting mechanism 227 to the sheet supplying roller 225. On the other hand, the third conveying roller 256 is rotated when the rotary drive force is transmitted thereto from the second drive motor 302 via the transmission selector 310 and a second drive-force transmitting mechanism 315 (as an example of a second transmission mechanism), namely, when the transmission selector 310 selects the second drive-force transmitting mechanism 315 for thereby causing the rotary drive force to be transmitted via the selected second drive-force transmitting mechanism 315 to the third conveying roller 256. It is noted that the second drive-force transmitting mechanism 315 is constituted by a plurality of gears meshing with each other.

The transmission selector 310 includes a sun gear 313 and a planet gear 314. The sun gear 313 meshes with an intermediate gear 244 that is configured to transmit the rotary drive force from the second drive motor 302. The planet gear 314 is to be rotated while being revolved around the sun gear 313. When the second drive motor 302 is rotated in a reverse direction (indicated by arrow 317 in FIG. 13), the planet gear 314 is revolved around the sun gear 313 so as to be positioned in a position (indicated by broken line 314 in FIG. 13) in which the planet gear 314 is caused to mesh with one of the gears constituting the second drive-force transmitting mechanism 315. On the other hand, when the second drive motor 302 is rotated in a forward direction (indicated by arrow 316 in FIG. 3), the planet gear 314 is revolved around the sun gear 313 so as to be positioned in a position (indicated by solid line 314 in FIG. 13) in which the planet gear 314 is caused to mesh with one of the gears constituting the first drive-force transmitting mechanism 227. Owing to this construction, the transmission selector 310 is configured, when the second drive motor 302 is rotated in the forward direction, to transmit the rotary drive force from the second drive motor 302 to the sheet supplying roller 325, and is configured, when the second drive motor 302 is rotated in the reverse direction, to transmit the rotary drive force from the second drive motor 302 to the third conveying roller 256. In other words, the transmission selector 310 is configured to select, based on the direction of rotation of the second drive motor 302, one of the first and second drive-force transmitting mechanisms 227, 315, for thereby causing the rotary drive force to be transmitted, via the selected one of the first and second drive-force transmitting mechanisms 227, 315, to a corresponding one of the sheet supplying roller 225 and the third conveying roller 256.

The third conveying roller 256 is arranged to be freely rotatable in a state in which the rotary drive force is not transmitted thereto from the second drive motor 302, i.e., in a state in which the planet gear 314 does not mesh with the gear of the second drive-force transmitting mechanism 315. Owing to this arrangement, the third conveying roller 256 can be rotated together with conveyance of the recording sheet, when the recording sheet is further conveyed by the sheet supplying roller 225 after having been brought into contact with the third conveying roller 256.

Figure 11:
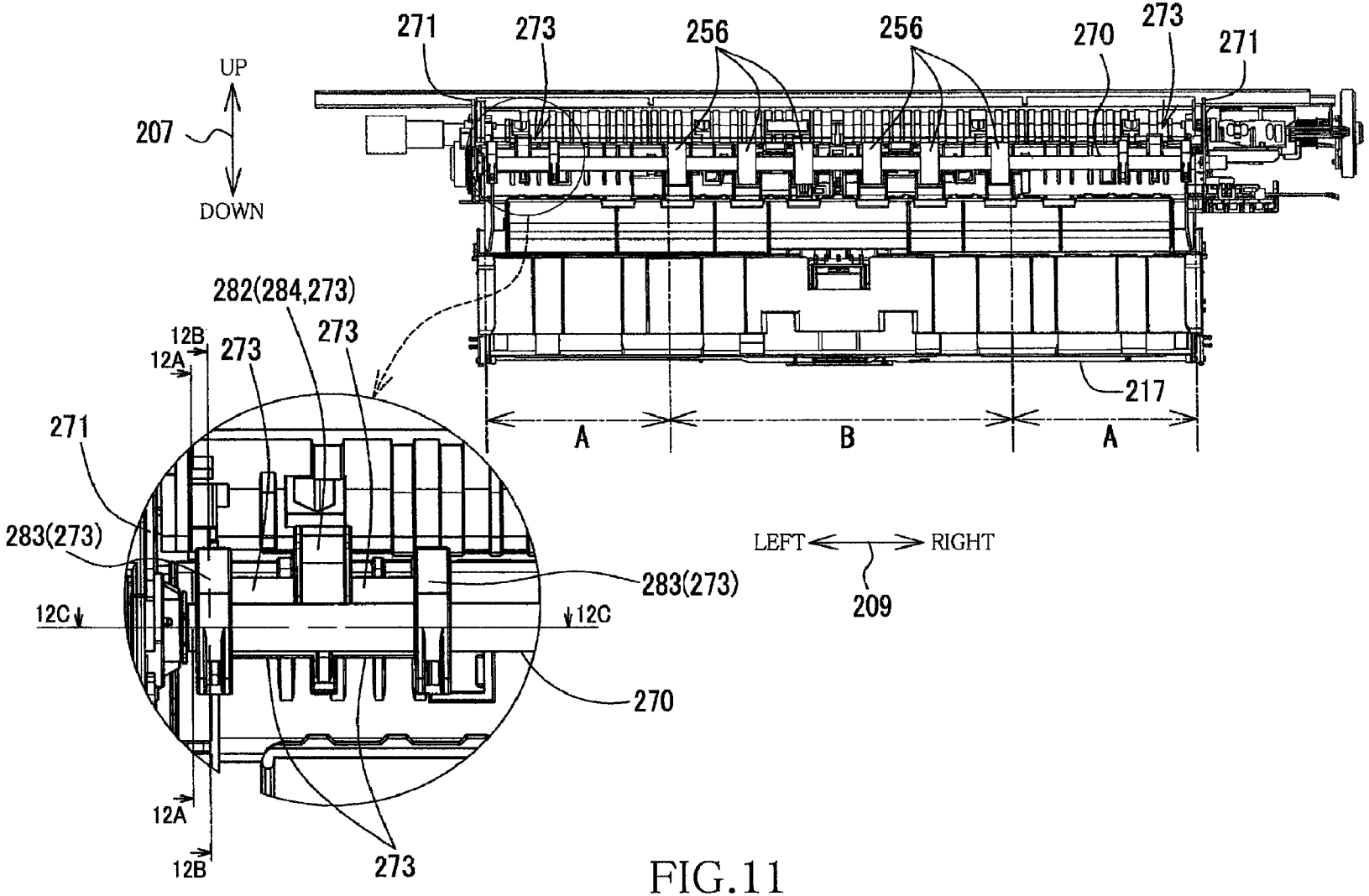
FIG. 11 is a rear view showing an outside guide member 217 and third conveying rollers 256 of the compound machine 210.

As shown in FIG. 11, a pair of frames 271 (as examples of support members) are disposed outside widthwise opposite ends of the curved path section 266 of the sheet conveyance path 265 in the right-left direction 209. The shaft 270 (as an example of a shaft) of the third conveying rollers 256 is supported in its opposite end portions in the right-left direction 209 by the frames 271. That is, the shaft 270 is disposed to extend in the right-left direction 209 (corresponding to a first direction) which is perpendicular to the sheet conveyance direction and which is parallel to the inside guide surface 219A or the outside guide surface 217A.

As shown in FIGS. 9 and 10, the shaft 270 is disposed on a side of the outside guide surface 217A which is remote from the curved path section 266 of the sheet conveyance path 265, namely, the shaft 270 is disposed in the outside guide member 217. Further, a distance from the inside guide surface 219A to the shaft 270 is larger than a distance from the inside guide surface 219A to the outside guide surface 217A, in a direction 277 (corresponding to a second direction and indicated by broken line with two arrows in FIG. 9) that is perpendicular to the sheet conveyance direction and the right-left direction 209. That is, the shaft 270 is located in a position that is distant from the inside guide surface 219A than from the outside guide surface 217A.

Further, as described above, the shaft 270 is received in the recessed portion 72 when the outside guide member 217 takes the closing posture.

As shown in FIGS. 8 and 11, the third conveying rollers 256 are mounted on the shaft 270, and are rotatable about an axis of the shaft 270 together with the shaft 270.

The third conveying rollers 256 are arranged and spaced apart from one another in the right-left direction 209. The pinch rollers 257, which are opposed to the respective third conveying rollers 256, are arranged and spaced apart from one another in the right-left direction 209. The number of the pinch rollers 257 is equal to the number of the third conveying rollers 256. In the present second embodiment, the number of the third conveying rollers 256 is six while the number of the pinch rollers 257 is also six. However, the number of the third conveying rollers 256 and the pinch rollers 257 is not particularly limited.

The six third conveying rollers 256 are not provided in opposite end portions (that are indicated by regions A in FIG. 11) of the curved path section 266 of the sheet conveyance path 265 in the right-left direction 209. Rather, the six third conveying rollers 256 are provided in an intermediate portion (that is indicated by a region B in FIG. 11) of the curved path section 266 of the sheet conveyance path 265 in the right-left direction 209.

When the outside guide member 217 takes the closing posture, as shown in FIG. 10, a part of each of the third conveying rollers 256 protrudes from the recessed portion 272, while most of each of the third conveying rollers 256 is accommodated or received in the recessed portion 272, so that each of the third pairs of rollers 255 is capable of conveying the recording sheet, by nipping the sheet in the curved path section 266.

The sheet supplying roller 225 is rotatable by a rotary drive force, which is transmitted from the second drive motor 302 via the transmission selector 310 and the first drive-force transmitting mechanism 227 when the second drive motor 302 is rotated in the forward direction, namely, when the transmission selector 310 selects the first drive-force transmitting mechanism 227. On the other hand, the third conveying roller 256 is rotated when the rotary drive force is transmitted thereto from the second drive motor 302 via the transmission selector 310 and the second drive-force transmitting mechanism 315. That is, the third conveying roller 256 is rotated when the second drive motor 302 is rotated in a reverse direction, namely, when the transmission selector 310 selects the second drive-force transmitting mechanism 315. It is noted that the second drive-force transmitting mechanism 315 is constituted principally by a plurality of gears meshing with each other,

[Sheet Guide Member 273]

As shown in FIGS. 8, 10 and 11, the sheet guide member 273 (as an example of a guide-surface member) is disposed on each of opposite end portions (that are indicated by regions A in FIG. 11) of the shaft 270 in the right-left direction 209. The opposite end portions of the shaft 270 are portions of the shaft 270 on which the third conveying rollers 56 are not disposed. Described more precisely, the sheet guide member 273 is disposed in a portion of the region A which is in proximity with the corresponding frame 271. It is noted that the sheet guide member 273 does not have to be disposed only in the portion of the region A which is close to the corresponding frame 271, but may be disposed in an entirety of the region A.

The sheet guide member 273, as being disposed on the shaft 270, has a shape that is symmetrical in the right-left direction 209. Further, the sheet guide member 273 is disposed to extend along the sheet conveyance path, from the vicinity of a downstream end, as viewed in the sheet conveyance direction, of the curved path section 266, to the vicinity of an upstream end, as viewed in the sheet conveyance direction, of the straight path section 267.

Figure 12C:
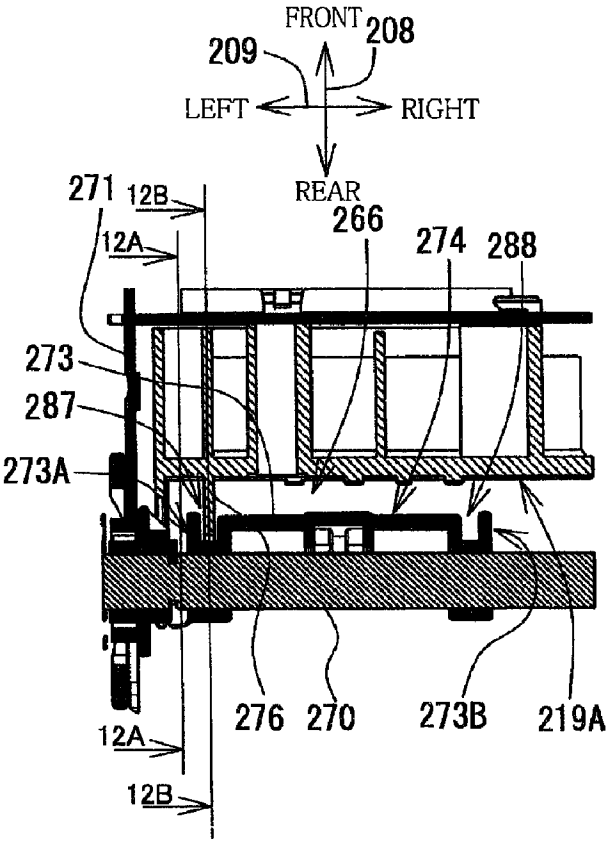
FIG. 12C is a cross sectional view taken along line 12C-12C in FIG. 11.
Figure 12B:
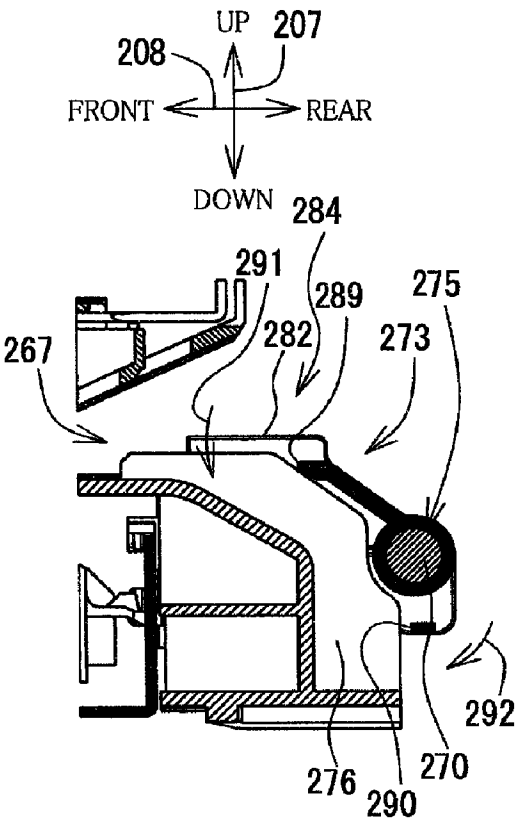
FIG. 12B is a cross sectional view taken along line 12B-12B in FIG. 11.
Figure 12A:
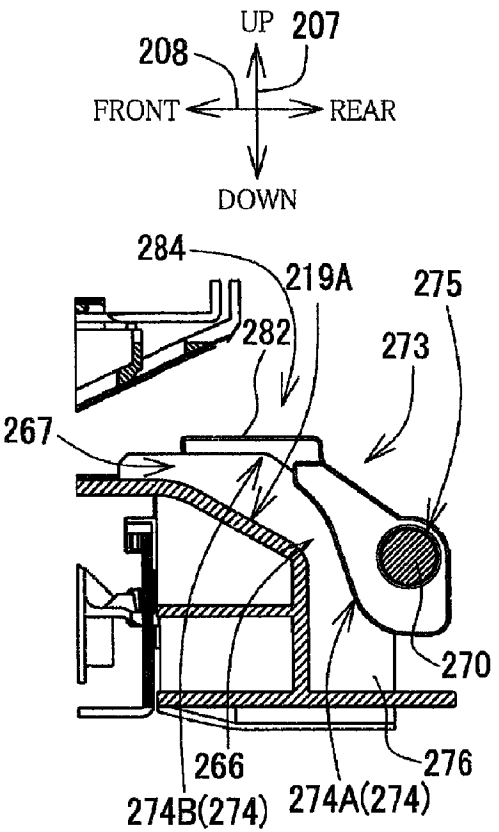
FIG. 12A is a cross sectional view taken along line 12A-12A in FIG. 11.

As shown in FIGS. 12A and 12B, the shaft 270 passes through a through-hole 275 that is provided in the sheet guide member 273, such that the sheet guide member 273 is not rotatable together with the shaft 270 but is rotatable independently of the shaft 270. However, as described below, the sheet guide member 273 is arranged to be unrotatable.

As shown in FIG. 12C, a protruding portion 276 is provided to protrude from an outside portion of the inside guide member 219 which is located outside the curved path section 266 of the sheet conveyance path 265 in the right-left direction 209, toward the curved path section 266. Meanwhile, two recessed portions 287, 288 are provided in respective opposite end portions of the sheet guide member 273 in the right-left direction 209. The protruding portion 276 is introduced in the recessed portion 287 as an outside one of the two recessed portions 287, 288 in the right-left direction 209. Further, as shown in FIG. 12B, each of the recessed portions 287, 288 is provided with first and second contact portions 289, 290.

Owing to the provision of the first contact portion 289, when the sheet guide member 273 is caused to be rotated in a direction indicated by an arrow 291, this rotation of the sheet guide member 273 is prevented by contact of the first contact portion 289 with the protruding portion 276. Owing to the provision of the second contact portion 290, when the sheet guide member 273 is caused to be rotated in a direction indicated by an arrow 292, this rotation of the sheet guide member 273 is prevented by contact of the second contact portion 290 with the protruding portion 276.

Further, when the sheet guide member 273 is caused to be slidingly moved in the right-left direction 209, this slide movement of the sheet guide member 273 is prevented by contact of the protruding portion 276 with a side surface of the recessed portion 287 in the of the right-left direction 209, as shown in FIG. 12C. Thus, owing to the contact of the protruding portion 276 with the side surface of the recessed portion 287, the sheet guide member 273 is positioned in a predetermined position in the right-left direction 209.

When the outside guide member 217 takes the exposing posture, the sheet guide member 273 is movable in the direction 277 (see FIG. 9). On the other hand, when the outside guide member 217 takes the closing posture, the sheet guide member 273 is forced, by the outside guide member 217, to be positioned in a position that is located in the innermost end of a movable range over which the sheet guide member 273 is movable in the direction 277, namely, in a position that is located in an end of the movable range which is close to the inside guide member 219. Thus, when the outside guide member 217 takes the closing posture, the sheet guide member 273 is unmovable in the direction 277 and is positioned in the above-described position in the direction 277.

The rotation of the sheet guide member 273, the slide movement of the sheet guide member 273 in the right-left direction 209 and the movement of the sheet guide member 273 in the direction 277 do not have to be prevented necessarily by the above-described arrangements but may be prevented by arrangements other than the above-described arrangements.

As shown in FIGS. 10 and 12A, the sheet guide member 273, which is disposed on the shaft 270, has a sheet guide surface 274 (as an example of a sheet guide surface) that faces the curved path section 266 of the sheet conveyance path 265.

The sheet guide surface 274 includes curved surface portions 274A (as examples of first curved surface portions) and a curved surface portion 274B (as an example of a second curved surface portion) which extend along the sheet conveyance path 265. Each of the curved surface portions 274A, 274B of the sheet guide surface 274 has a curved shape identical with a curved shape of the major part of the outside guide surface 217A (i.e., a curved shape of the outside guide surface 217A except the flat surface 222).

As shown in FIG. 11, the sheet guide member 273 includes a pair of curved portions 283 which are located in opposite end portions of the sheet guide member 273 in the right-left direction 209. Each of the curved portions 283 has a shape that is symmetrical in the right-left direction 209. Further, the two curved portions 283 are located in respective positions which are symmetrical with respect to a center of the sheet guide member 273 in the right-left direction 209. The above-described curved surface portions 274A of the sheet guide surface 274 are constituted by surfaces of the respective curved portions 283 which face the curved path section 266 of the sheet conveyance path 265.

Further, as shown in FIG. 11, the sheet guide member 273 includes a curved portion 284 which is located in a central portion of the sheet guide member 273 in the right-left direction 209. The curved portion 284 includes a protruding portion 282 protruding toward the straight path section 267 (see FIGS. 12 A, 12B) and having a distal end that is located on a downstream side, as viewed in the sheet conveyance direction, of each of the curved portions 283. The curved portion 284 has a shape that is symmetrical in the right-left direction 209. The above-described curved surface portion 274B of the sheet guide surface 274 are constituted by a surface of the curved portion 284 which face the curved path section 66 of the sheet conveyance path 265.

In the present second embodiment, the curved surface portions 274A and the curved surface portion 274B of the sheet guide surface 274 lie on the same surface. That is, a central portion of the sheet guide surface 74 extends to a position that is located on a downstream side, as viewed in the sheet conveyance direction, of a position to which opposite end portions of the sheet guide surface 274 extend. However, the curved surface portions 274A and the curved surface portion 274B of the sheet guide surface 274 may lie on different surfaces. In this modification, each of the curved surface portions 274A is constituted by a curved rectangular surface while the curved surface portion 274B is constituted by a curved rectangular surface having a downstream end that is located on a downstream side of a downstream end of the curved rectangular surface of each of the curved surface portions 274A, so that the sheet guide surface 74 is constituted by the three curved rectangular surfaces of the curved surface portions 274A and the curved surface portion 274B.

Further, a distance from the inside guide surface 219A to the sheet guide surface 274 is shorter than a distance from the inside guide surface 219A to the shaft 270 in the direction 277 (see FIG. 9). In the present second embodiment, the sheet guide member 273 is located such that the distance from the inside guide surface 219A to the sheet guide surface 274 is larger than a distance from the inside guide surface 219A to the outside guide member 217. Thus, the sheet guide member 273 has the sheet guide surface 274 that is closer to the inside guide surface 219A than the shaft 270. In other words, the distance between the inside guide surface 219A and the sheet guide surface 274 is smaller than the distance between the inside guide surface 219A and the shaft 270.

It is noted that the sheet guide member 273 may be disposed such that the distance from the inside guide surface 219A to the sheet guide surface 274 is equal to the distance from the distance from the inside guide surface 219A to the outside guide member 217.

[Flat Surface 222]

As shown in FIGS. 9 and 10, a major part of the outside guide surface 217A of the outside guide member 217 is curved to define the curved path section 266. However, as shown in FIGS. 10 and 17B, the flat surface 222 (as an example of a sheet supporting portion constituted by a flat surface) is provided on an immediately downstream side, as viewed in the sheet conveyance direction, of a position in which the third conveying roller 256 is disposed.

The flat surface 222 may extend from the position of the third conveying roller 256 either to a downstream end, as viewed in the sheet conveyance direction, of the curved path section 266, or to a midway position located on an upstream side, as viewed in the sheet conveyance direction, of the downstream end of the curved path section 266. In the present first embodiment, the flat surface 222 is constituted by a portion of the outside guide surface 217A, which extends from the position of the third conveying roller 256 to a position that is substantially the center between the third pairs of rollers 255 and the first pairs of rollers 258. Meanwhile, the outside guide surface 217A includes a curved portion that is located on a downstream side, as viewed in the sheet conveyance direction, of the position that is substantially the center between the third pairs of rollers 255 and the first pairs of rollers 258.

The flat surface 222 extends from the position of the third conveying roller 256 in a forward and upward direction. Described specifically, a front end portion (i.e., a downstream end portion) of the flat surface 222 is located on an upper side of a rear end portion (i.e., an upstream end portion) of the flat surface 222. In other words, a height position of the flat surface 222 is increased as the flat surface 222 extends forwardly. The outside guide surface 217A includes, in addition to the sheet supporting portion in the form of the flat surface 222, an upstream-side non-flat portion and an downstream-side non-flat portion which are located on upstream and downstream sides of the flat surface 222, wherein a direction of a tangent line tangent to the outside guide surface 217A is changed at a boundary between the flat surface 222 and the downstream-side non-flat portion by a degree smaller than a degree by which the direction of the tangent line is changed at a boundary between the flat surface 222 and the upstream-side non-flat portion.

[Judging Portion]

The printer unit 211 has a judging portion (as an example of a judging portion) including a detector (as an example of a leading-end-portion detector) and a rotary encoder 322 (as an example of a rotation-amount detector). The detector is configured to detect a leading end portion of the sheet which has been supplied from the sheet supply tray 220 and which is being conveyed along the curved path section 266. The rotary encoder 322 is configured to detect an amount of rotation of the sheet supplying roller 225. It is noted that the judging portion and the detector are identical with the judging portion 120 and the detector 121 in the above-described first embodiment so that redundant descriptions thereof will not be provided.

[Controlling Portion 330]

As shown in FIG. 14, the controlling portion 330 is configured to control activations of the entirety of the compound machine 210. The controlling portion 330 is a microcomputer constituted principally by CPU 331, ROM 332, RAM 333, EEPROM 334 and ASIC 335 which are connected to one another via an internal bus 337. Since the controlling portion 330, CPU 331, ROM 332, RAM 333, EEPROM 334 and ASIC 335 are identical in function with the controlling portion 130, CPU 131, ROM 132, RAM 133, EEPROM 134 and ASIC 135 in the above-described first embodiment, redundant descriptions thereof will not be provided.

[Conveyance Control by Controlling Portion 330]

Figure 15:
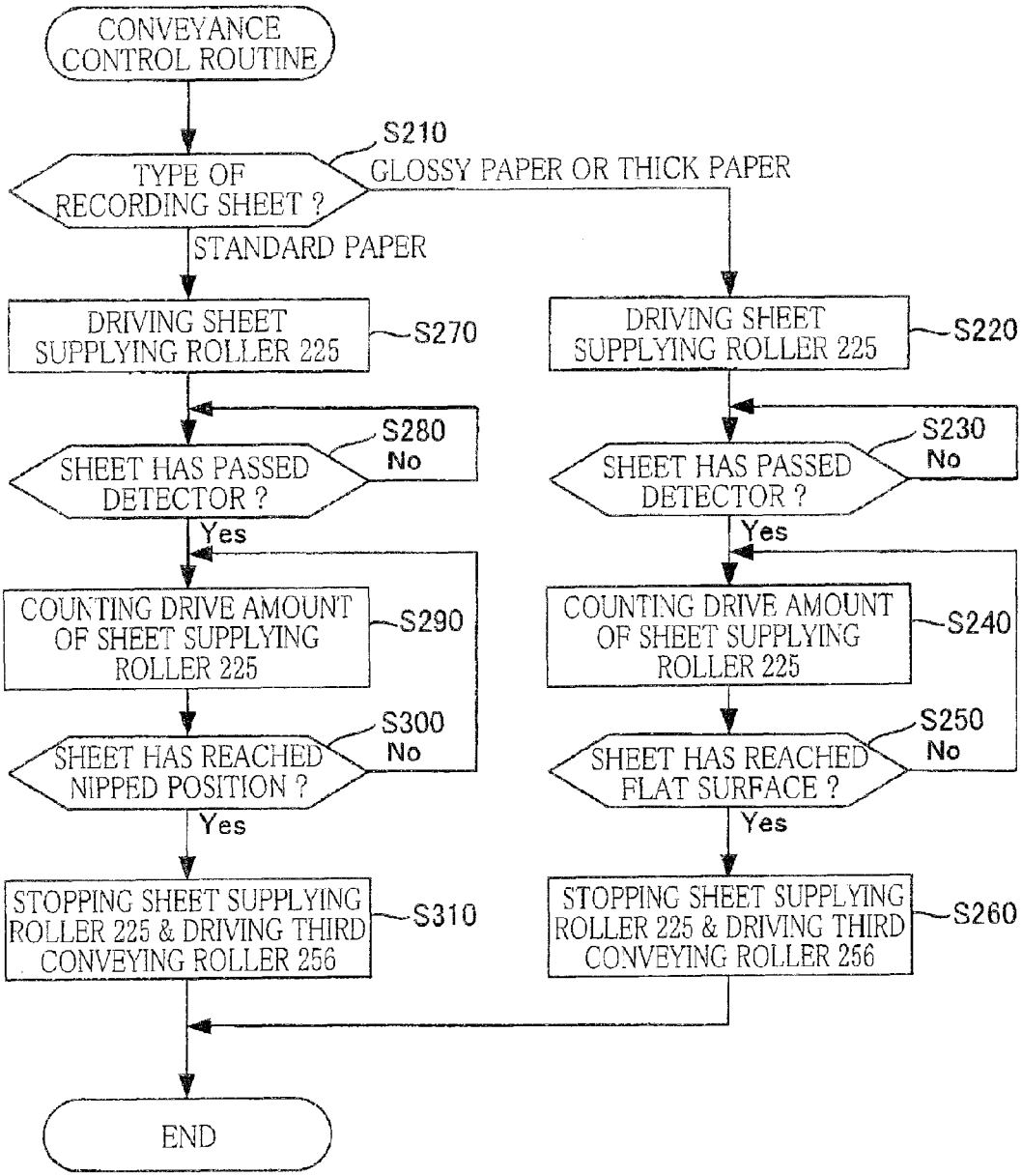
FIG. 15 is a flow chart of a conveyance control routine that is to be executed by the controlling portion 330.

In the printer unit 211 constructed as described above, the controlling portion 330 is configured to execute a conveyance control routine as shown in FIG. 15, for supplying a recording sheet and conveying the recording sheet along the sheet conveyance path 265. Since the conveyance control routine of FIG. 15 is substantially identical with the conveyance control routine of FIG. 6 in the above-described first embodiment, description thereof will not be provided.

Effects of Second Embodiment

In the above-described second embodiment, the recording sheet can be conveyed in the sheet conveyance direction by the third conveying rollers 256 and the pinch rollers 257 which cooperate to nip the recording sheet. Since the third conveying rollers 256 are disposed in respective positions that correspond to a non-end portion or central portion of the recording sheet in the right-left direction 209, it is possible to prevent the recording sheet from being conveyed in a direction inclined with respect to the sheet conveyance direction. The recording sheet, which is conveyed along the sheet conveyance path 265, is not nipped at its widthwise opposite end portions by the third conveying roller 256 and the pinch rollers 257.

Further, in the above-described second embodiment, since the third pairs of rollers 255 are located in the curved path section 266, the widthwise opposite end portions of the recording sheet, which are not nipped by the third conveying roller 56 and the pinch rollers 57, are inclined outwardly toward the outside guide surface 217A, so that the recording sheet has a shallow U shape in its cross section that is perpendicular to the sheet conveyance direction. Thus, each of the widthwise opposite end portions of the recording sheet, which is inclined by a given degree, is likely to be brought into contact with the shaft 270 so that there is a risk that the recoding sheet could be folded or broken. However, in the above-described second embodiment, the sheet guide members 273 are provided for enabling the widthwise opposite end portions of the recording sheet to be guided by the sheet guide surfaces 274 of the respective sheet guide members 273. Thus, it is possible to prevent the widthwise opposite end portions of the recording sheet from being brought into contact with the shaft 270.

Further, in the above-described second embodiment, the shaft 270 is attached to the unrotatable frames 271, rather than to the pivotable outside guide member 217, so that the shaft 270 is not moved in a state in which the recording sheet is nipped between the third conveying roller 56 and the pinch roller 57, whereby the accuracy of the conveyance of the recording sheet can be satisfactorily maintained. Further, when the recording sheet is jammed in the curved path section 266, the jammed sheet can be removed by causing the outside guide member 217 to take the exposing posture. In this instance, the recording sheet can be easily removed, since the sheet guide members 273 are disposed only in respective opposite end positions in the right-left direction 209.

Further, in the above-described second embodiment, the sheet guide surface 274 is located in a position outside of the outside guide surface 217A, namely, in a position closer to outside of the compound machine 210 as compared with the position of the outside guide surface 217A. It is therefore possible to reduce a possibility that a resistance is applied from the sheet guide surface 274 to the recording sheet, when the recording sheet is being conveyed along the curved path section 266 while being guided by the outside guide surface 217A.

Further, in the above-described second embodiment, the recording sheet is guided to be conveyed along the straight path section 267 of the sheet conveyance path 265, after having passed the curved path section 266 of the sheet conveyance path 265. The sheet guide surface 274 extends from the curved path section 266 to the straight path section 267, so that the sheet guide surface 274 is capable of guiding the recording sheet continuously from the curved path section 266 to the straight path section 267. Consequently, the accuracy of the conveyance of the recording sheet can be satisfactorily maintained.

Further, in the above-described second embodiment, the sheet guide members 273 are disposed on the respective opposite end portions of the shaft 270 in the right-left direction 209. Each of the sheet guide members 273 has a shape that is symmetrical in the right-left direction 209, so that two identical members in the form of the sheet guide members 273 can be attached to the respective opposite end portions of the shaft 270. In other words, the two sheet guide members 273 do not have to be constituted by two different members so as to be attached to the respective opposite end portions of the shaft 270. Therefore, it is possible to reduce the number of kinds of members that are to be used in the conveying device. Further, it is possible to simplify a process of manufacturing the conveying device.

Further, in the above-described second embodiment, the shaft 270 is attached to the frames 271 that are not pivotable rather than to the outside guide member 217 that is pivotable. Owing to this arrangement, the shaft 270 is not moved even when the recording sheet is nipped between the third conveying roller 256 and the pinch roller 257, whereby the accuracy of the conveyance of the recording sheet can be satisfactorily maintained. Consequently, it is possible to satisfactorily maintain the quality of image which is recorded on the recording sheet by the recording portion 224.

Further, like in the first embodiment, in the above-described second embodiment, the recording sheet is conveyed by the sheet supplying roller 225 when the opposite force acting in the direction opposite to the sheet conveyance direction is large, and the recording sheet is conveyed by the third pairs of rollers 255 when the opposite force is small. It is therefore possible to reduce a possibility that the rolling surfaces of the respective third conveying rollers 256 would slip on the surface of the recording sheet. Consequently, the quality of the image recorded on the recording sheet by the recording portion 224 can be satisfactorily maintained.

Modification 1 of Second Embodiment

Figure 16A:
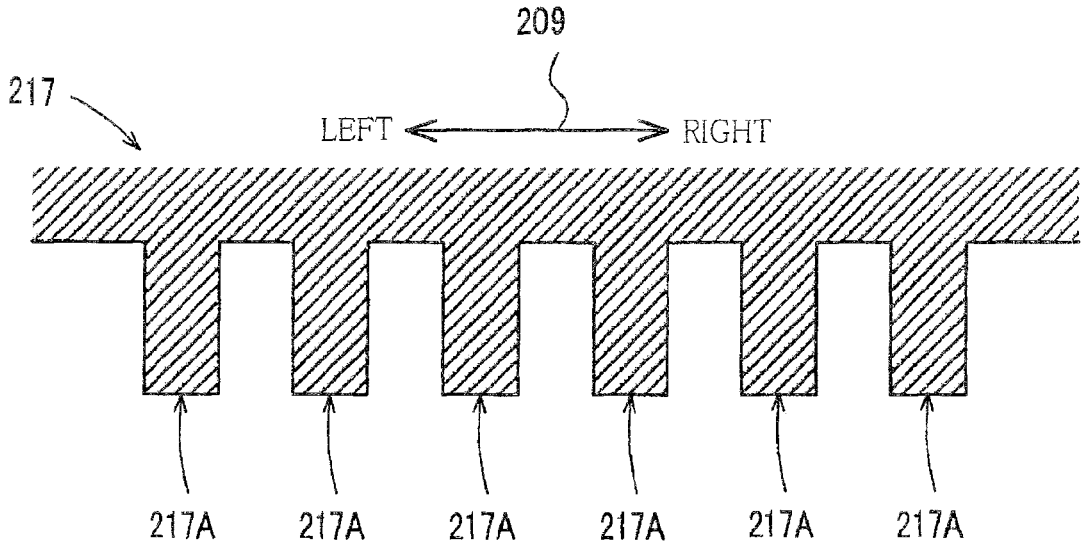
FIG. 16A is a cross sectional view showing a part of an outside guide member 217 where a plurality of rectangular-shaped ribs are provided on an outside guide surface 217A.
Figure 16B:
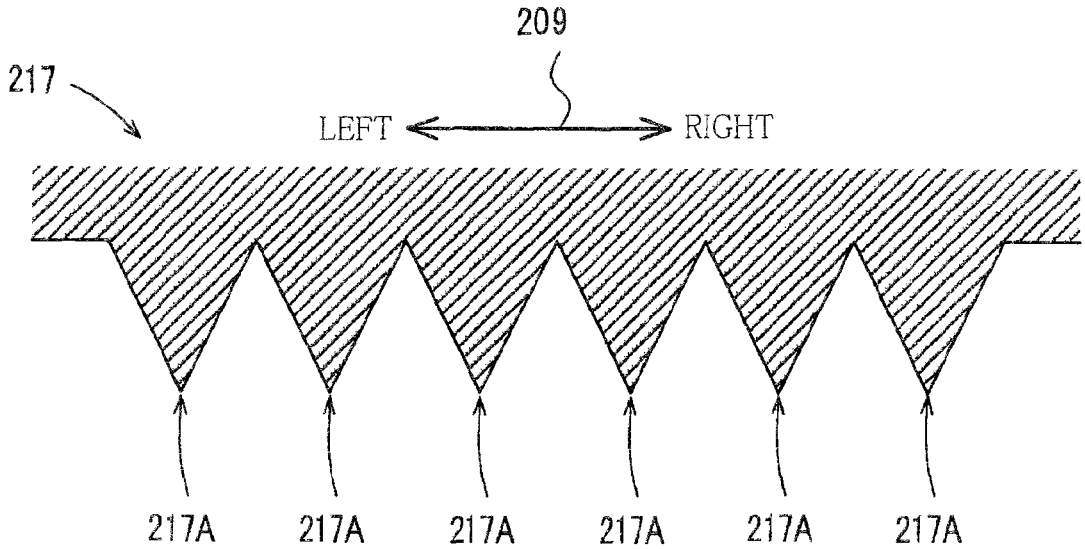
FIG. 16B is a cross sectional view showing a part of an outside guide member 217 where a plurality of triangular-shaped ribs are provided on an outside guide surface 217A.

Each of the inside guide surface 219A and the outside guide surface 217A may be constituted by either a single surface or a plurality of surfaces. In an arrangement where each of the guide surfaces 219A, 217A is constituted by a plurality of surfaces, for example, a plurality of ribs (as examples of ribs) may be provided to extend along the sheet conveyance path 265 and protrude from the inside guide surface 219A and/or the outside guide surface 217A toward the sheet conveyance path 265 (as shown in FIGS. 16A and 16B). In this arrangement, distal end faces of the respective ribs constitute respective surfaces, so that the inside guide surface 219A and/or the outside guide surface 217A are constituted by the plurality of surfaces.

In this modification 1, the plurality of ribs are not provided in positions, in the right-left direction 209, in which the sheet guide members 273 are provided. In other words, each of the sheet guide members 273 is disposed between adjacent two of the ribs in the right-left direction 209.

It is noted that some of the plurality of ribs may be provided with recessed portions so that the ribs can be disposed in the positions in which the sheet guide members 273 are provided. In this case, the ribs which are provided with the recessed portions are disposed in the positions in which the sheet guide members 273 are provided.

In this modification 1, since the outside guide surface 217A are constituted by the plurality of ribs, it is possible to reduce a contact area of the recording sheet that is to be in contact with the outside guide surface 217A., so that the recording sheet can be easily conveyed along the curved path section 266.

Modification 2 of Second Embodiment

In the above-described second embodiment, as shown in FIG. 12C, the protruding portion 276 is provided in the inside guide surface 219A, while the recessed portion 287 is provided in the sheet guide member 273, so that the sheet guide member 273 is positioned in a predetermined position in the right-left direction 209 by engagement of the protruding portion 276 with the recessed portion 287. However, this arrangement may be modified as follows:

In the modification 2, as shown in FIG. 12C, the sheet guide member 273 is supported by the frame 271, owing to an arrangement in which a left side surface 273A (i.e., outside surface as viewed in the right-left direction 209) of the sheet guide member 273 is in contact with the frame 271. Further, when the outside guide member 217 takes the closing posture, a right side surface 273B (i.e., inside surface as viewed in the right-left direction 209) of the sheet guide member 273 is in contact with a side surface (not shown), as viewed in the right-left direction 209, of the recessed portion 272 of the outside guide member 217. Thus, the sheet guide member 273 is sandwiched between the frame 271 and the side surface of the recessed portion 272 of the outside guide member 217, so as to be positioned in a predetermined position in the right-left direction 209.

If the outside guide member 217 is moved when the recording sheet is in contact with the outside guide member 217, the accuracy of the conveyance of the recording sheet could be reduced. However, in this modification 2, when the outside guide member 217 takes the closing posture, the sheet guide member 273 is in contact at its one-side surface with the frame 271, whereby the movement of the sheet guide member 273 in the right-left direction 209 is limited. Further, the sheet guide member 273 is in contact with the outside guide member 217, so as to be positioned in a predetermined position in the direction 277. Thus, the accuracy of the conveyance of the recording sheet can be satisfactorily maintained.

On the other hand, when the outside guide member 217 takes the exposing posture, the sheet guide member 273 is not in contact with the outside guide member 217 so that the sheet guide member 273 is movable in the right-left direction 209. Therefore, when the recording sheet is jammed in the curved path section 266, the recording sheet can be easily removed.

Modification 3 of Second Embodiment

In the above-described second embodiment, the sheet guide member 273 has a configuration as shown in FIGS. 10, 11, 12A, 12B and 12C. The configuration of the sheet guide member 273 is not limited to the above detail, as long as the configuration enables the sheet guide member 273 to guide the recording sheet. For example, the sheet guide member 273 may be constituted by at least one roller which is freely rotatably held by a shaft.

What is claimed is:

1. An image recording apparatus comprising:

a conveyance path definer including outside and inside guide surfaces which are opposed to each other and which cooperate with each other to define therebetween a conveyance path, along which a sheet is to be conveyed in a sheet conveyance direction while one and the other of opposite side faces of the sheet face said outside and inside guide surfaces, respectively, the conveyance path having a curved path section and a straight path section that is located on a downstream side of the curved path section;

a tray configured to hold a sheet;

a supplying roller which is to be in contact with the other of the opposite side faces of the sheet held by said tray, and which is configured to supply the sheet from said tray toward the curved path section of the conveyance path;

a pair of conveying rollers which are located in the curved path section of the conveyance path, and which are configured to convey the sheet supplied from said supplying roller, toward the straight path section of the conveyance path, said pair of conveying rollers including a drive roller and a driven roller, said drive roller being rotatable by a drive force transmitted thereto and disposed on a side of said outside guide surface so as to be brought into contact with the one of the opposite side faces of the sheet, said driven roller being opposed to said drive roller and disposed on a side of said inside guide surface so as to be brought into contact with the other of the opposite side faces of the sheet;

a recording portion which is located in the straight path section of the conveyance path, and which is disposed on a side of said outside guide surface so as to record image on the one of the opposite side faces of the sheet; and a controlling portion which is configured to control said supplying roller and said drive roller;

wherein said outside guide surface includes a sheet supporting portion constituted by a flat surface which faces the curved section and which extends away from said drive roller toward the straight path section, said image recording apparatus further comprising:

a judging portion configured to make judgment relating to a position of a leading end portion of the sheet, wherein said controlling portion is configured, upon receipt of a command requesting start of conveyance of the sheet, to cause said supplying roller to be rotated without causing said drive roller to be rotated, and is configured, upon judgment that the leading end portion of the sheet has reached said sheet supporting portion, to cause said drive roller to be rotated.

2. The image recording apparatus according to claim 1, wherein said flat surface, which constitutes said sheet supporting portion of said outside guide surface, extends toward the straight path section, from an immediately downstream side of a position in which said drive roller is disposed.

3. The image recording apparatus according to claim 1, wherein said outside and inside guide surfaces cooperate with each other to define therebetween the conveyance path such that the curved path section of the conveyance path is curved to be convex in a direction toward the side of said outside guide surface away from the side of said inside guide surface.

4. The image recording apparatus according to claim 1, wherein said controlling portion is configured to control said supplying roller and said drive roller, in accordance with a selected one of first and second modes, which is selected based on information representing type of the sheet held in said tray, wherein, when the first mode is being selected, said controlling portion is configured, upon receipt of the command requesting start of conveyance of the sheet, to cause said supplying roller to be rotated without causing said drive roller to be rotated, and is configured, upon judgment that the leading end portion of the sheet has reached said sheet supporting portion, to cause said drive roller to be rotated, wherein said judging portion is configured to judge whether or not the leading end portion of the sheet has reached a nipped position in which the leading end portion is nipped between said conveying rollers, and wherein, the second mode is being selected, said controlling portion is configured, upon judgment that the leading end portion of the sheet has reached the nipped position, to cause said drive roller to be rotated and to stop rotation of said supplying roller.

5. The image recording apparatus according to claim 1, wherein said judging portion includes (i) a leading-end-portion detector which is located on an upstream side of said pair of conveying rollers and which is configured to detect the leading end portion of the sheet conveyed along the conveyance path, and (ii) a rotation-amount detector configured to detect an amount of rotation of said supplying roller, and wherein said judging portion is configured to make the judgment relating to the position of the leading end portion of the sheet, based on the amount of rotation of said supplying roller which has been detected after detection of the leading end portion of the sheet by said leading-end-portion detector.

6. The image recording apparatus according to claim further comprising:

a drive source configured to generate a drive force;

a first transmission mechanism configured to transmit the drive force from said drive source to said supplying roller;

a second transmission mechanism configured to transmit the drive force from said drive source to said drive roller; and a transmission selector configured to select one of said first and second transmission mechanisms, for thereby causing the drive force to be transmitted, via the selected one of said first and second transmission mechanisms, to a corresponding one of said supplying roller and said drive roller.

7. The image recording apparatus according to claim 6, wherein said drive roller is freely rotatable in a state in which the drive force is transmitted from said drive source to said supplying roller via said first transmission mechanism.

8. The image recording apparatus according to claim 1, wherein said outside guide surface includes, in addition to said sheet supporting portion constituted by said flat surface, an upstream-side non-flat portion and an downstream-side non-flat portion which are located on upstream and downstream sides of said flat surface, respectively, and a direction of a tangent line tangent to said outside guide surface is changed at a boundary between said flat surface and said downstream-side non-flat portion by a degree smaller than a degree by which the direction of the tangent line is changed at a boundary between said flat surface and said upstream-side non-flat portion.

9. The image recording apparatus according to claim 1, further comprising:

a pair of support members disposed outside respective widthwise opposite ends of the conveyance path in a first direction which is perpendicular to the sheet conveyance direction and which is parallel to a direction of width of the conveyance path;

a shaft disposed on the side of said outside guide surface, and located in a position which is more distant from said inside guide surface than from said outside guide surface in a second direction that is perpendicular to the first direction and the sheet conveyance direction, said shaft being rotatably supported at opposite end portions thereof by said support members; and a pair of guide-surface members disposed on respective non-central portions of said shaft in the first direction, each of said guide-surface members having a sheet guide surface, wherein a distance between said inside guide surface and said sheet guide surface is smaller than a distance between said inside guide surface and said shaft, wherein said drive roller is disposed on a non-end portion of said shaft in the first direction, and is rotatable together with said shaft, wherein said non-central portions of said shaft are located on respective opposite sides of said non-end portion of said shaft in the first direction, and wherein said drive roller cooperates with said driven roller to convey the sheet by nipping the sheet therebetween.

10. The image recording apparatus according to claim 9, wherein said conveyance path definer includes an outside guide member having said outside guide surface, wherein said outside guide member is displaceable so as to take selectively first and second postures, such that said inside guide surface is exposed to an exterior of said conveying device, when said outside guide member takes the first posture, and such that said inside guide surface cooperates with said outside guide surface to define the curved path section of the conveyance path therebetween, when said outside guide member takes the second posture, and wherein said outside guide member has a recessed portion that is recessed in said outside guide surface, such that said shaft is receivable in said recessed portion when said outside guide member takes the second posture.

11. The image recording apparatus according to claim 10, wherein said guide-surface members are supported by said support members, each of said guide-surface members being held in a position by contact of said each of said guide-surface members with said outside guide member when said outside guide member takes the second posture.

12. The image recording apparatus according to claim 9, wherein said outside guide surface is constituted by a plurality of ribs which extend in the sheet conveyance direction and which are arranged in the first direction.

13. The image recording apparatus according to claim 9, wherein said outside guide surface is constituted by a plurality of ribs which extend in the sheet conveyance direction and which are arranged in the first direction, and wherein each of said guide-surface members is disposed between adjacent two of said ribs in the first direction.

14. The image recording apparatus according to claim 9, wherein said sheet guide surface of each of said guide-surface members is located between said shaft and said outside guide surface in the second direction.

15. The image recording apparatus according to claim 9, wherein said sheet guide surface of each of said guide-surface members extends from the curved path section of the conveyance path to the straight path section of the conveyance path which is located on the downstream side of the curved path section.

16. The image recording apparatus according to claim 9, wherein each of said guide-surface members has a shape that is symmetric in the first direction, wherein said sheet guide surface of each of said guide-surface members includes first curved surface portions provided in respective non-central portions of said guide-surface member in the first direction, wherein said sheet guide surface of each of said guide-surface members includes a second curved surface portion provided in a non-end portion of said guide-surface member in the first direction, wherein said non-central portions of said guide-surface member are located on respective opposite sides of said non-end portion of said guide-surface member in the first direction, and wherein said second curved surface portion extends from the curved path section of the conveyance path to the straight path section of the conveyance path which is located on the downstream side of the curved path section, such that a downstream end of said second curved surface portion is located on a downstream side of a downstream end of each of said first curved surface portions.

* * * * *